US005642897A

United States Patent [19]

Couderc et al.

[11] Patent Number: 5,642,897

[45] Date of Patent: Jul. 1, 1997

[54] SKI BRAKE AND DEVICE FOR MODIFYING THE NATURAL PRESSURE DISTRIBUTION OF A SKI OVER ITS SLIDING SURFACE AND A SKI EQUIPPED THEREWITH

[75] Inventors: Bernard Couderc, Annecy; Pierre Szafranski, Pringy, both of France

[73] Assignee: Salomon S.A., Metz-Tessy, France

[21] Appl. No.: 291,909

[22] Filed: Aug. 18, 1994

Related U.S. Application Data

[63] Continuation-in-part of Ser. No. 12,436, Feb. 2, 1993, Pat. No. 5,397,149, and a continuation-in-part of PCT/FR92/01082, Nov. 23, 1992, published as WO93/15797, Aug. 19, 1993.

[30] Foreign Application Priority Data

Feb. 18, 1992 [FR] France ..... 92 01958
Feb. 18, 1992 [FR] France ..... 92 01959

[51] Int. Cl.[6] ..... A63C 7/10

[52] U.S. Cl. ..... 280/605; 280/607; 280/618

[58] Field of Search ..... 280/605, 617, 280/618, 607, 602, 636

[56] References Cited

U.S. PATENT DOCUMENTS

| | | | |
|---|---|---|---|
| 2,560,693 | 7/1951 | Hickman | 280/610 |
| 3,989,271 | 11/1976 | Riedel | 280/605 |
| 3,992,030 | 11/1976 | Salomon | 280/605 |
| 4,061,356 | 12/1977 | Salomon | 280/605 |
| 4,123,083 | 10/1978 | Salomon | 280/605 |
| 4,361,343 | 11/1982 | Luitz | 280/605 |
| 4,544,177 | 10/1985 | Svoboda | 280/605 |
| 4,676,520 | 6/1987 | Gasquet et al. | 280/605 |
| 4,896,895 | 1/1990 | Bettosini | 280/607 |
| 5,033,766 | 7/1991 | Sedlmair et al. | 280/605 |
| 5,135,250 | 8/1992 | Abondance et al. | 280/617 |
| 5,332,253 | 7/1994 | Couderc et al. | 280/602 |
| 5,397,149 | 3/1995 | Couderc et al. | 280/602 |

FOREIGN PATENT DOCUMENTS

| | | | |
|---|---|---|---|
| 1270867 | 6/1990 | Canada | A63C 5/00 |
| 0182776 | 5/1986 | European Pat. Off. | A63C 9/00 |
| 0183586 | 6/1986 | European Pat. Off. | A63C 9/00 |
| 0409749 | 1/1991 | European Pat. Off. | A63C 9/00 |
| 2513132 | 3/1983 | France | A63C 7/10 |
| 2541124 | 8/1984 | France | A63C 7/10 |
| 2259375 | 6/1974 | Germany | A63C 5/07 |
| 4101997 | 9/1991 | Germany | A63C 9/00 |
| 4039331 | 6/1992 | Germany | A63C 9/08 |
| WO82/01651 | 8/1980 | WIPO | A63C 7/10 |
| WO83/03360 | 10/1983 | WIPO | A63C 9/00 |
| WO93/11838 | 6/1993 | WIPO | A63C 9/00 |
| WO93/15797 | 8/1993 | WIPO | A63C 9/00 |

*Primary Examiner*—Robert J. Oberleitner
*Assistant Examiner*—Michael Mar
*Attorney, Agent, or Firm*—Greenblum & Bernstein, P.L.C.

[57] ABSTRACT

The invention is related to a ski brake including two braking arms and a spring for returning the braking arms into an active braking position. The activation mechanism of the braking arms include two levers which extend between the front and rear binding elements, and are mutually journalled in the manner of a toggle joint.

32 Claims, 16 Drawing Sheets

4
10
17
18
20
25
29
35
38
40
43
44
45
46
47
49
50
51
60
76

SKI BRAKE AND DEVICE FOR MODIFYING THE NATURAL PRESSURE DISTRIBUTION OF A SKI OVER ITS SLIDING SURFACE AND A SKI EQUIPPED THEREWITH

CROSS-REFERENCE TO RELATED APPLICATIONS

This application is a continuation-in-part of U.S. patent application No. 08/012,436, filed on Feb. 2, 1993, now U.S. Pat. No. 5,397,149, issued on Mar. 14, 1995, and a continuation-in-part of International Patent Application No. PCT/FR92/01082, filed on Nov. 23, 1992, published as WO 93/15797 on Aug. 19, 1993, the disclosures of both of the aforementioned applications are hereby expressly incorporated by reference thereto in their entireties and the priorities of which are claimed under 35 U.S.C. 120.

Further, this application is based upon French Patent Application No. 92.01958, filed on Feb. 18, 1992, and is also based upon French Patent Application 92.01959, filed on Feb. 18, 1992, the disclosures of both of the aforementioned French applications are hereby expressly incorporated by reference thereto in their entireties and the priorities of which are hereby claimed under 35 U.S.C. 119.

BACKGROUND OF THE INVENTION

1. Field of the Invention

The invention is related to a ski brake that is adapted to brake the movement of a ski, especially an alpine ski, in case the boot which is retained on the ski is released. The invention is also related to a ski equipped with the device or the brake mentioned hereinabove.

The invention is also related to a device whose object is to modify the natural pressure distribution of a ski, such as especially an alpine ski, over its sliding surface.

2. Description of Background and Relevant Information

Skis that are used for alpine skiing are constituted by relatively long members, the boots of the skier being retained thereupon by front and rear binding elements. The boots and the binding elements are located approximately in the median zone of the ski, which is commonly known as the middle sole. The skis themselves possess a natural arch at rest, whereby the middle sole is naturally raised with respect to the front end of the ski or spatula, and the rear end of the ski or heel. In addition, the skis possess a flexibility, which is a function of their internal structure. During skiing, the ski deforms elastically in response to the various stresses to which it is subject from the skier, and from the terrain on which it slides.

The main forces to which a ski is subjected are constituted by the weight of the skier and by the reaction to which the sliding surface subjects the ski.

The ski is also biased by the binding elements. It is, in fact, known that the binding elements pinch the boot along a longitudinal direction. The reaction to this pinching action is transmitted by the binding elements to the ski. This reaction, however, differs in nature according to the assembly mode of the rear binding element to the ski. Indeed, some rear binding elements are directly assembled to the ski, whereas others are assembled on the front binding element by a non-extensible link, such as a metallic plate which extends beneath the boot.

The ski is also influenced by the position of the skier on his or her boots, depending on whether his or her weight is carried towards the front or towards the rear.

It is known that the behavior of the ski on snow can be modified, especially the ease with which it handles turns, and the quality of its movements in turns, or in a straight line, by influencing the arch of the ski, or else by playing with the longitudinal pressure distribution of the ski on the snow. By playing with this pressure distribution, it is known that the ski can be rendered more or less pivotal or more or less guiding, i.e., one can promote its ability to turn easily or to display great stability of movement. In currently available skis, the pressure distribution of the ski on the snow is determined mainly by the internal structure of the ski and by the assembly mode of the binding elements to the ski, that is, with or without the connection plate between the front and rear elements. Pressure distribution can also be influenced by the intensity of the thrust that is provided to the return springs.

There exist devices with attached elements that enable the pressure distribution of the ski on the snow to be modified. As such, European Patent Application No. 183,586 describes a plate of an elastic material of a spring blade type attached above the ski, between the binding elements and the ski. This blade has cursors at the level of its front and rear ends, by virtue of which a part of the forces to which the ski is subject are transmitted vertically. This device, however, has a disadvantage of providing only mediocre performance and it is very cumbersome. It is adapted for cases where both feet of the skier are in support on the same ski, so as to avoid the entire weight of the skier from being concentrated in the middle sole zone. On the other hand, it is ill-adapted to cases where a pair of traditional skis are used.

Also known, as exemplified by European Patent Publication No. 409,749, is a device constituted by a plate which is raised with respect to the upper surface of the ski and is maintained between two longitudinal abutments. The elastic shock absorption means are positioned between the plate and the abutments, and the pre-stress exerted on such elastic means is adjustable. As for the bindings, they are assembled on the plate. This device provides good results, but its disadvantage is that the binding elements are affixed to the attached plate and not to the ski itself.

Other devices of the same type are described for example in U.S. Pat. No. 2,560,693 and the German Patent No. 2,259,375.

It must be noted that in these devices, the pre-stress that the attached element induces on the ski itself cannot be eliminated. This pre-stress affects the ski, even in the absence of the boot and even when the skis are stored. The ski is therefore continually subject to a stress that affects its flexion, even at rest. It can thus be subject to an irreversible deformation due to this pre-stress.

In addition, these devices are provided to be equipped with standard binding and braking elements. In particular, there is no provision for specific brake arrangements that take into account the presence of the element that has been attached onto the ski.

Skis usually used for skiing are indeed most often equipped with a brake that is intended to brake the movement of the ski in case of accidental release of the boot.

The brake includes two braking arms movable between a working position, wherein they project beneath the sole of the ski, and a resting position wherein they rise above the ski.

A spring or an elastic return means elastically returns the braking arms into the working position.

Generally, the brake is associated with the rear binding element, i.e., the base of the brake which bears the arms continuously extends the base of the rear binding element.

Currently known brakes are automatic, i.e., the movement of the braking arms is directly influenced by the engagement of the boot in the binding elements, or else by the accidental or voluntary disengagement of the boot from the binding elements.

The control or influence means are most often a foot or sole-engaging pedal which projects above the upper surface of the ski. When the boot is engaged in the binding elements, this pedal is pressed against the upper surface of the ski.

Such brakes are known, for example, from U.S. Pat. Nos. 3,989,271 or 4,123,083.

The space requirement of these brakes on the ski is not substantial, such that they do not exert a stiffening action on the structure of the ski, or exert a negligible action as little as possible.

In addition, a disadvantage of these known brakes is the presence of increased friction between the sole-engaging pedal and the boot. Indeed, certain brakes provide a very substantial resistance upon engagement of the boot in the binding elements.

SUMMARY OF THE INVENTION

One of the objects of the invention is to propose a ski brake that, in association with the front and rear binding elements, exerts an action on the stiffness of the ski, and owing to this fact, on the pressure distribution of the ski on the snow.

Another object of the invention is to propose a ski brake which enables the ski to be subject to a pre-stress that can be eliminated, particularly in the absence of the boot.

Another object of the invention is to propose a ski brake whose construction is simple and, in addition, is easy to maneuver with the boot.

The ski brake according to the invention is associated with a pair of front and rear binding elements. The ski brake includes movable braking arms, a return spring which acts to bring back the braking arms into the active braking position, and activations means for controlling the movement of the braking arms.

According to a first characteristic of the invention relating to the brake, the activation means include two levers journalled in the manner of a toggle joint, which generally extend between the front and rear binding elements.

According to another characteristic of the invention, the braking arms are located in the extension of one of the levers, i.e., within the plane of one of the levers.

According to another characteristic of the invention, a spring acts between the levers to bias the toggle joint into the open position.

According to another characteristic, the front end of the front lever is connected to a base located beneath the front binding element.

According to another characteristic, the rear end is connected to a base located beneath the rear binding element.

Another object of the invention is to provide a device that enables modification of the pressure distribution of a ski over its sliding surface, i.e., a device that takes into account the position of the skier on his or her skis, and the vertical thrust force exerted by the skier on the skis.

Another object of the invention is to provide a device that includes, in addition, a suspension effect to the skier while skiing.

Yet another object of the invention is to provide a device that induces a pre-stress in the ski, this pre-stress being capable of being eliminated, particularly in the absence of the boot, when the ski is stored.

Another object of the invention is to provide a ski brake whose elements are integrated into the pressure distribution device.

The device according to the invention is adapted to equip a ski, such as especially an alpine ski, with at least one binding element adapted to retain a boot in its central middle sole zone, and at least one support element on which the sole of the boot rests.

More particularly, the device provides:

a sensor element capable of sensing vertical biases of the boot, as well as linking means between the sensor element and the base, in order to transmit at least towards one of the ends of the base, in the form of a flexional moment, at least a part of the downward vertical thrust of the boot which is sensed by the sensor element, that the linking means include calibration means so as to induce, in the linking means, a pre-stress that can vary between two values, a determined non-zero value for sliding, and a zero value for other non-sliding circumstances, that the linking means have activation means sensitive to the presence or absence of the boot in order to automatically control the pre-stressing of the calibration means when the boot is engaged in the binding elements.

The ski brake according to the invention comprises at least one mobile brake arm between a working position wherein the arm projects beneath the lower surface of the ski, and a resting position wherein the arm rises along the lateral edges of the ski. It comprises activation means to bring back the arms from their working position to their resting position during engagement of the boot in the retention binding, and an energy means to elastically return the arms into the working position during release of the boot.

More particularly, the activation means comprise an assembly of two levers oriented along the longitudinal direction of the ski above such ski, the levers being journalled with respect to each other about a horizontal and transverse axis in the manner of a non-stable knuckle joint, mobile between an open position and a flattened position against the upper surface of the ski, wherein one of the levers bears the brake arms and wherein both levers are, in addition, connected to the base of the ski by linking means in which they generate a calibration pre-stress when the boot is engaged in the binding elements and activates the knuckle joint into a flattened position.

BRIEF DESCRIPTION OF THE DRAWINGS

The invention will be better understood with reference to the description that follows, as well as the annexed drawings which form an integral part of it, of preferred embodiments.

DETAILED DESCRIPTION OF THE PREFERRED EMBODIMENTS

Figure 1:
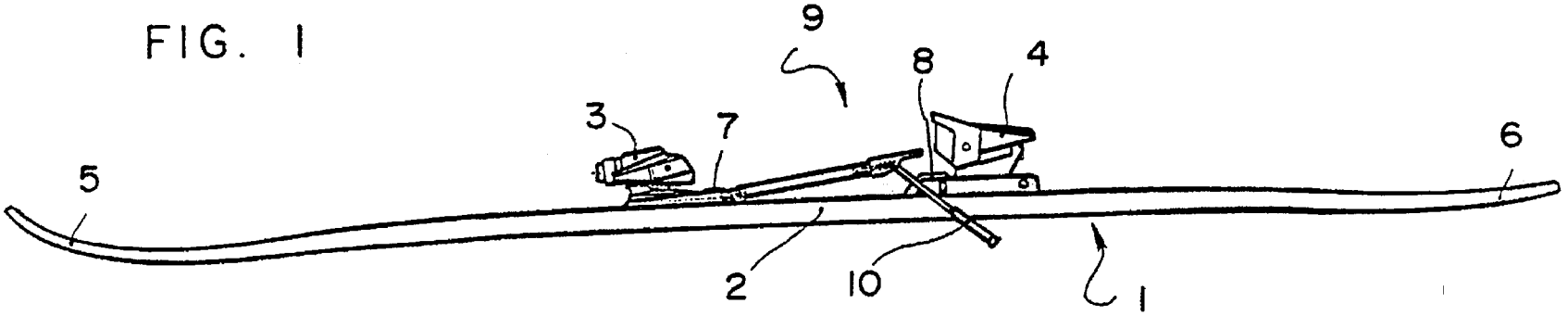
FIG. 1 is a general side view of a ski equipped with the device according to a first non-limiting embodiment of the invention.
Figure 2:
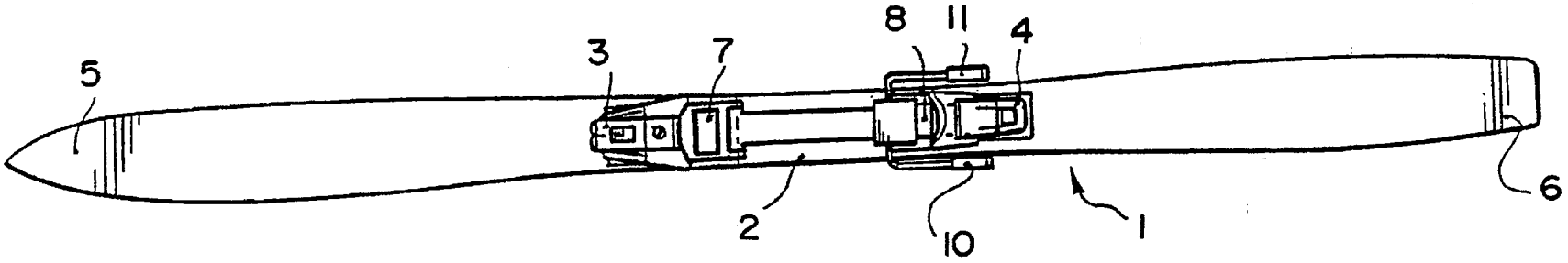
FIG. 2 is a top view of the device represented in FIG. 1.

FIG. 1 represents an alpine ski comprising a base 1, which is equipped in its middle sole zone 2 with a front binding element 3 and a rear binding element 4. Base 1 has an elongate shape, with a raised front end or spatula 5 and a rear end or heel 6.

The front and rear binding elements are of any appropriate type, and are not described in detail. They are adapted to retain the front and rear ends of the boot, and to release the boot when it exerts excessive bias on any of the elements.

In a known manner, in the case of the ski represented in FIG. 1, the sole of the boot rests on base 1 by a front support element 7, and a rear support element 8, which are respectively associated with the front binding element 3 and the rear binding element 4.

The device represented in FIG. 1 also comprises a brake 9 between the binding elements 3 and 4, such brake having two lateral braking arms 10 and 11, or more generally, at least one braking arm.

Figure 3:
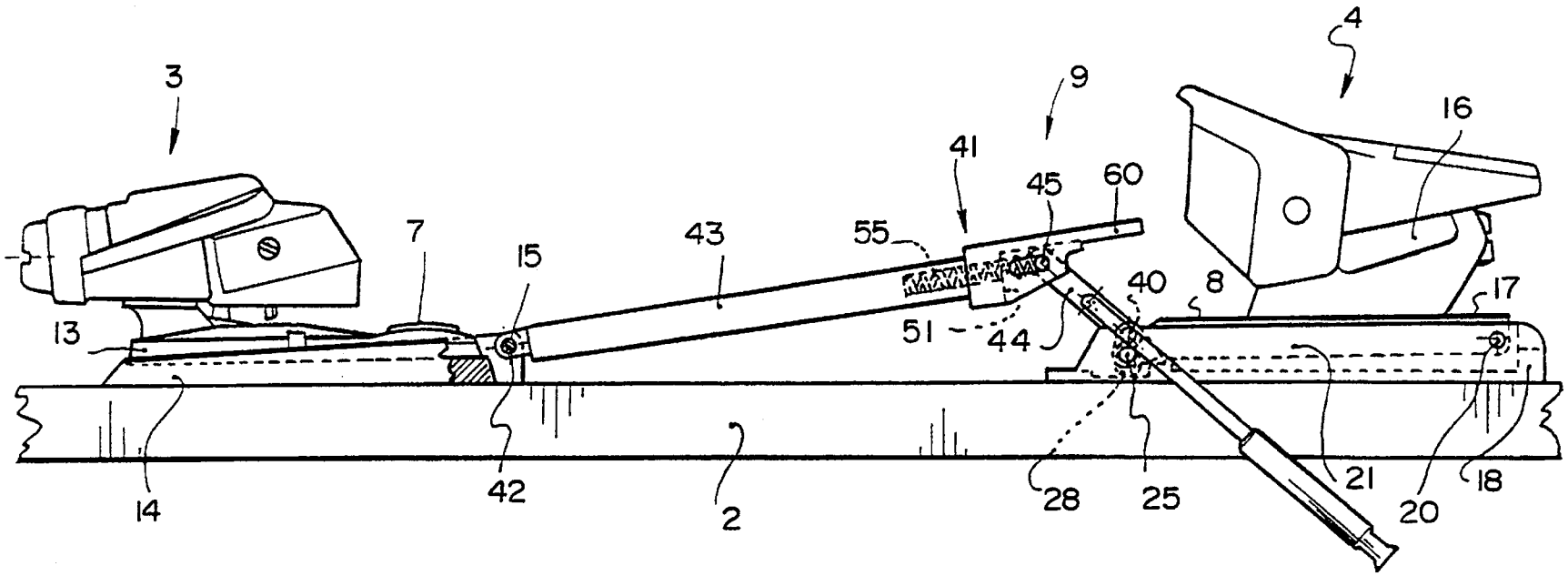
FIG. 3 is a partial sectional side view of the device represented in FIG. 1 in its middle sole zone.

With reference to FIG. 3, the front binding element 3 has in its lower portion a plate 13, which is affixed to the ski. Preferably, plate 13 is mounted on a base plate 14, which raises it slightly with respect to the upper surface of the base of the ski. The assembly constituted by plate 13 and base plate 14 i.e., elements associated with the front binding element 3, is fixed by any appropriate means, for example, by screws which are not visible in FIG. 3. The rear portion of the base plate has an opening 15, so as to receive a horizontal and transverse axis. This housing is raised with respect to the upper surface of ski base 1. Its particular function is described further below.

The rear binding element 4 has, in a known manner, a body 16 which is longitudinally mobile along a slide 17. Slide 17 is connected to base 1 by means of a base plate 18 affixed to the ski.

Base plate 18 basically has two longitudinal and vertical wings 21 and 22, whose spacing is slightly greater than the width of slide 17, such that slide 17 can be engaged between the two wings. In FIG. 3 only wing 21 is visible.

The journal between slide 17 and base plate 18 takes place by a pivoting movement about an axis which is parallel to a transverse and horizontal direction. In FIG. 3, this axis is embodied as a journal axle or pin 20, which crosses slide 17 and base plate 18. Journal axle 20 is raised with respect to the upper surface of base 1. Naturally, this is not limiting, and any other journal means may suffice.

Slide 17 can thus pivot in a vertical and longitudinal plane defined by the longitudinal direction of the ski.

Conversely, it can be noted that the link between slide 17 and base plate 18 does not allow other movements of slide 17 except this movement in the median vertical and longitudinal plane of the ski.

Preferably, this pivoting movement is limited at least upwardly. These limiting means are represented in the drawings in the form of a transverse and horizontal pin 25, which is affixed to the front portion of slide 17, and whose ends cross wings 21 and 22 of base plate 18 at the level of the oblong openings 28 and 29. These openings are generally configured with respect to pin 25, so as to enable not only the vertical movement, but also the longitudinal movement of such pin. The upper portion of the oblong holes 28 and 29 constitutes an abutment for pin 25, the abutment limiting the upward movement of slide 17. The downward movement of the slide can be limited by the ski itself, or else by the lower portion of oblong holes 28 and 29.

Slide 17 is obtained from any appropriate material which can resist a compression bias directed along its length.

The device according to the invention also comprises a sensor element capable of sensing the vertical biases exerted by one end of the sole of the boot. Further, it comprises linking means between the sensor element and base 1 of the ski, in order to transform a vertical downward bias exerted on the sensor into at least one flexional moment which tends to make one end of the ski plunge towards the snow.

In the embodiment illustrated, the linking means basically comprise a pivoting or tipping element 35 and its support wedge 38, front linking means that are basically constituted by a linking element 41 connected to the front base plate 14, and rear linking means that are basically constituted by slide 17 which is connected to base plate 18.

The linking means transform the vertical downward thrust of the boot into two longitudinal thrust forces, respectively oriented frontwardly and rearwardly with respect to the ski. The longitudinal frontward thrusting force is exerted on front base plate 14 at the level of housing 15 which is described above. It is to be understood that a longitudinal force towards the front exerted at this level is transmitted to the base in the form of a flexional moment, which tends to make the spatula bend towards the snow. The longitudinal thrust towards the rear is exerted on rear base plate 18 at the level of journal axle 20 with slide 17. A longitudinal thrust force towards the rear exerted at this level is transmitted to the base in the form of a flexional moment which tends to make the heel of the base bend towards the snow.

The intensity of the flexional moments induced on the front and rear of the base depends on the intensity of the longitudinal thrusts, and also on the height of housings 15 or axle 20 with respect to the upper surface of the base.

Preferably, the front or rear linking means themselves comprise calibration means to induce in the linking means, between front base plate 14 and rear base plate 18, a thrust pre-stress which is also transmitted to tipping element 35.

These calibration means are adjusted automatically in accordance with the presence or absence of the boot, between a zero or substantially zero value if the boot is absent and a predeterminate value if the boot is present.

In the embodiment which is illustrated in the drawings, the linking means comprise, initially, a tipping element 35 having two arms, a vertical arm 35*a* and a horizontal arm 35*b*, oriented towards the rear. Tipping element 35 is borne by the front portion of slide 17, about pin 25 described previously. The pin crosses tipping element 35 in its central portion, at the level of the link between arms 35*a* and 35*b*.

Slide 17 which constitutes the rear linking means thus connects tipping element 35 to rear base plate 18.

The horizontal arm 35*b* of the tipping element extends behind pin 25 and it is in support, along a vertical direction, against wedge 38 affixed to the base. In the example illustrated, wedge 38 is a part of base plate 18. It could, however, be separate from the base plate and be affixed to base 1.

In the upper portion of tipping element 35, approximately above the housing for pin 25, there is an opening for a horizontal and transverse axis 40, on which the front linking element 41 is connected. This element 41 is connected in its front portion to base plate 14 by a transverse axle 42 which is engaged in opening 15 of such base plate.

The front linking element 41 is constructed of two elements oriented along the longitudinal direction of base 1, the elements being journalled in the manner of a knuckle joint. Thus, linking element 41 comprises a front lever 43 and a rear lever 44 which are mutually journalled about a transverse and horizontal axis 45. The free front end of lever 43 is journalled at base plate 14 about the axis of axle 42 and the rear end of lever 44 is connected to tipping element 35 by the journal axis of axle 40. The knuckle joint thus formed by elements 43 and 44 is movable between an open position which is represented in FIG. 3 and a closed position which is represented in FIG. 4.

It is the boot represented by reference numeral 47 that enables the knuckle joint to pass from its open position to its closed or flattened position. In addition, the flattened position is an unstable position in terms of equilibrium, i.e., the central axis 45 is elastically and permanently returned upwardly, in such a way that as soon as the boot is released, the knuckle joint opens automatically.

According to the embodiment represented in FIGS. 3–7, journal axis 45 which is common to both levers 43 and 44 is borne by lever 44, and it is movable in a slot 50 of the other lever 43 which comprises two symmetrical portions carried by lateral wings 48 and 49, and is oriented along the longitudinal direction defined by such lever 43. When the knuckle joint passes from its open position to its flattened position, axis 45 moves along with the front portion of lever 44 and it crosses slot 50 of lever 43 towards the front. Thereby, the rear end portion of the front lever 43 can be said to be pivotally and slidably connected to the rear lever 44.

Figure 4:
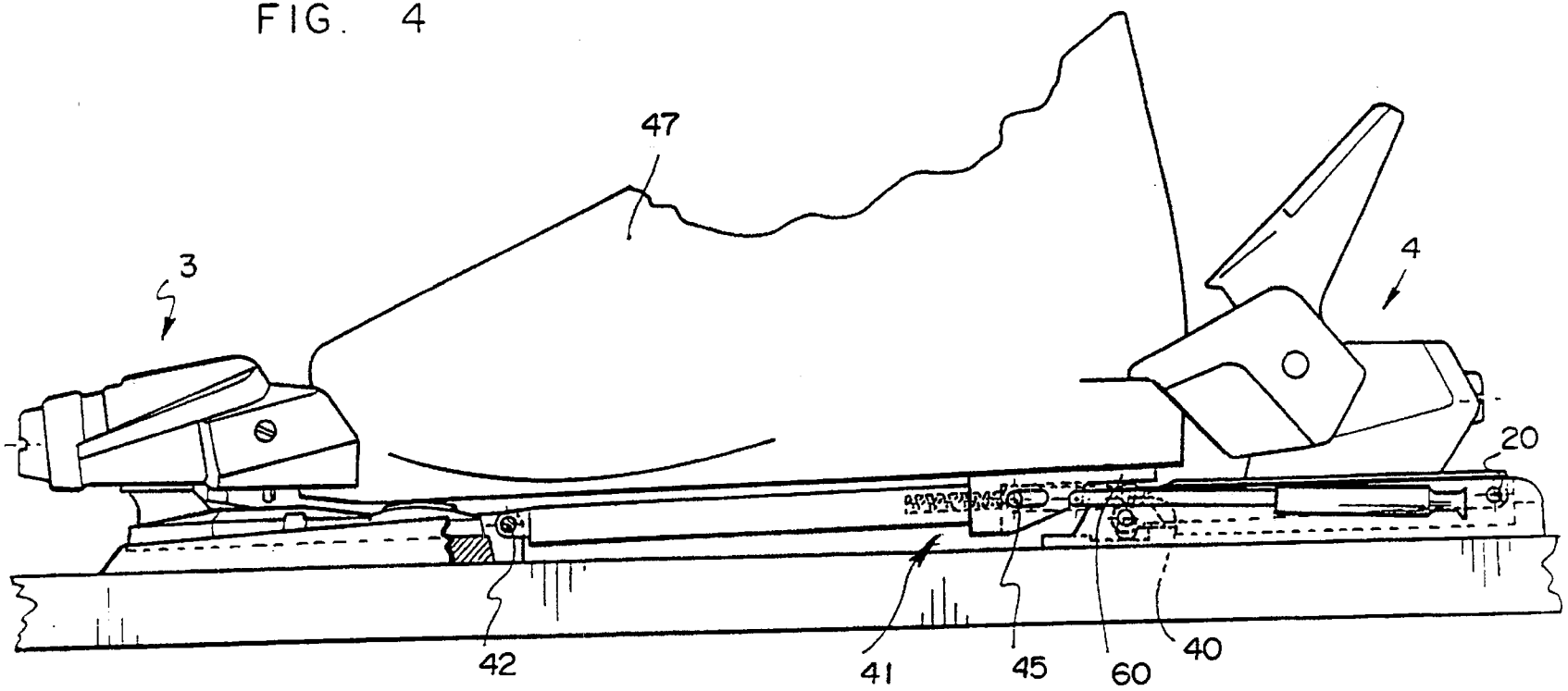
FIG. 4 is a view similar to FIG. 3 and illustrates another functional position of the device.

Preferably, in the flattened position of the knuckle joint, i.e., the position of FIG. 4, axle 45 is in abutment at the front of slot 50. In addition, in this position, rear lever 44 and front lever 43 are preferably in direct support against one another along a longitudinal direction, so as to transmit to one of these elements the compression stresses originating from the other. In the case of the drawings, lever 43 has, in its rear portion, just in front of slot 50, a vertical support face 51 against which the front end 52 of lever 44 becomes positioned when the knuckle joint is flattened.

An elastic return means is, moreover, provided to elastically return the knuckle joint into the open position. In the case of FIGS. 3–7, this elastic return means is constituted by an assembly of two springs 55 and 56, which are located in longitudinal housings 57 of front lever 43, these housings opening in their rear portion, at the level of support face 51, in such a way that the springs push the front end of lever 44 towards the rear.

In addition, journal axis of axle 45 of both levers 43 and 44 is permanently located above the alignment of the axes of axles 42 and 40, such that the knuckle joint is never totally closed or placed in a stable lower position. A wedge affixed to lever 43 or base 1 could also retain axis 45 above the alignment of axles 40 and 42.

However, this is non-limiting, and other appropriate elastic return means can be used.

The pre-stress which is induced by these calibration means in the linking means originates partially from the support of front end 52 of lever 44 against face 51 of front lever 43, from the stress that the closure of the knuckle joint induces, and partially from springs 55 and 56.

According to a preferred embodiment, front lever 43 extends in its rear portion beyond slot 50, by a plate 60. In the flattened position of the knuckle joint, plate 60 is in contact with the sole of the boot, and it covers lever 44 up until journal axle 40 with tipping element 35. When the boot is present in the binding, the rear portion of the sole is in contact with plate 60. The vertical downward bias to which the boot subjects plate 60 is transmitted to tipping element 35 at the level of axle 40. Axle 40 is offset longitudinally with respect to the support of horizontal arm 35*b* of the tipping element on wedge 38, in such a way that a substantial downward bias tends to produce a rotation of the tipping element about its support on wedge 38. Plate 60 constitutes a sensor element which is in contact with the sole of the boot at the level of its rear end, and which is capable of sensing the vertical biases of the boot, especially those oriented downwardly.

The functioning of the device that has been described is as follows.

In the absence of a boot, i.e., in the position of FIG. 3, springs 55 and 56 elastically return the knuckle joint constituted by levers 43 and 44 into its open position.

When the boot is engaged in the binding, as represented in FIG. 4, the rear portion of the sole of the boot takes support on plate 60, which brings the knuckle joint into its flattened position, without, however, connection axis 45 between the two levers exceeding the alignment of axles 40 and 42, so that the knuckle joint is in a non-stable equilibrium, and so that it is maintained in this position only due to the presence of the boot. In this position, the pre-stress induced by the linking means, as well as by springs 55 and 56, is sufficient to maintain the tipping element in its raised position, i.e., a position wherein the ends of axle 25 are in abutment in the upper portion of oblong holes 28 and 29, when the boot is in normal equilibrium on the ski.

Figures 7, 11:
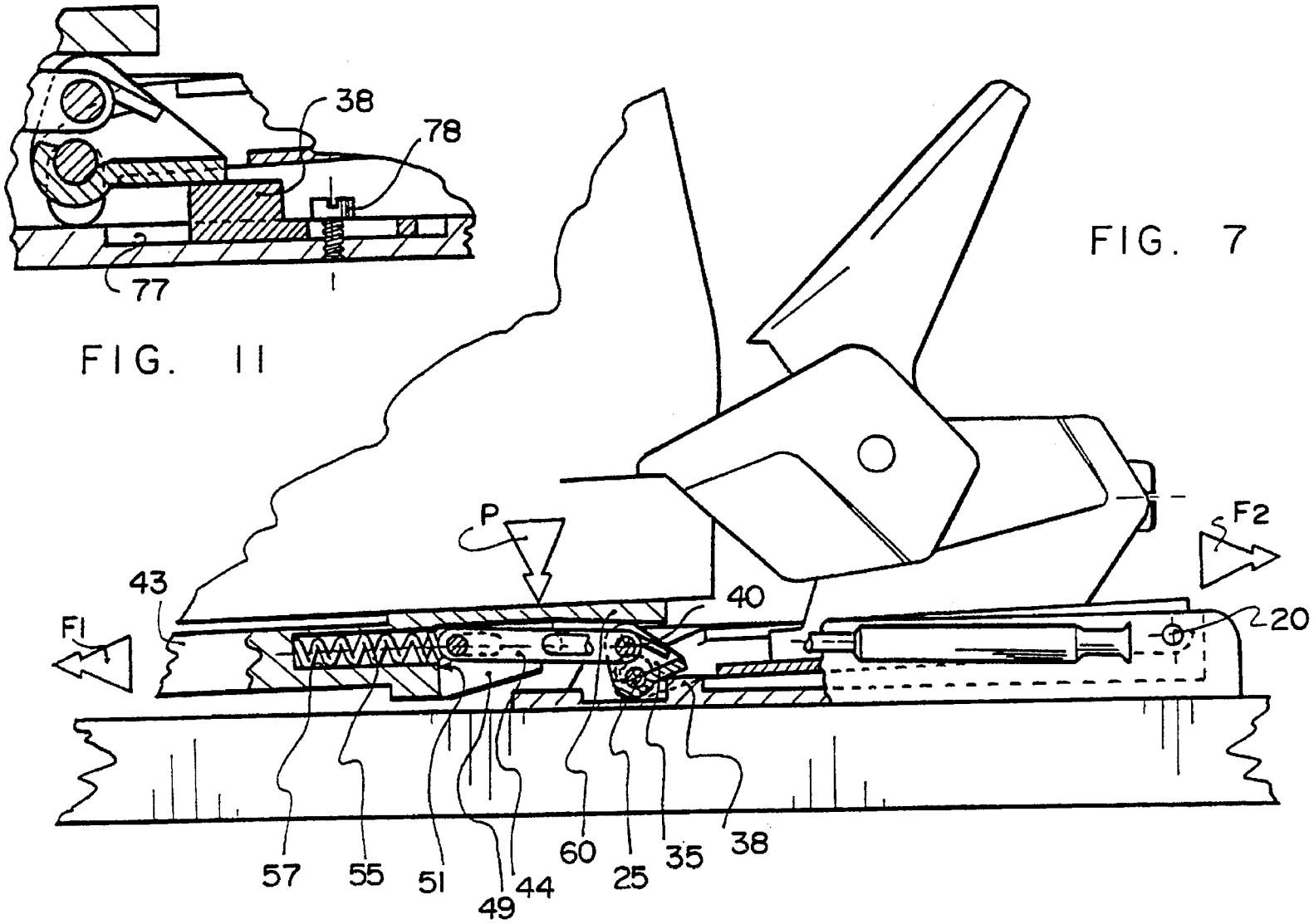
FIG. 7 is a side view similar to FIG. 5, and illustrates another functional position of the device.

FIG. 7 illustrates the case wherein the rear end of the boot exerts, on the ski, an additional thrust P oriented vertically downwardly, which overcomes the pre-stress. This can occur especially when the skier bears his weight at the rear of the ski. In this case, this thrust P is transmitted to tipping element 35, and results in its pivoting about the support that the horizontal branch 35*b* of the tipping element takes on wedge 38. This pivoting tends to displace journal axis 40 of front linking element 41 towards the front, and journal axis 25 of slide 17 towards the rear. This induces, in the front linking element 41 and rear linking element 17, a thrust force which is oriented towards each of the ends of base 1, as has been illustrated in FIG. 7 by arrows F1 and F2. The frontward thrust force F1 is transmitted to the front base plate 14 at the level of axle 42, and it induces on the front portion of the base of the ski a flexional moment which tends to make the spatula bend towards the snow. Similarly, the rearward thrust force F2 towards the rear is transmitted to rear base plate 18 at the level of journal axis of axle 20, and it induces, in the rear portion of base 1, a flexional moment which tends to make the heel of base 1 bend towards the snow.

Forces F1 and F2 are, in fact, generated by action and reaction. The respective intensity is not necessarily equal. It depends on the position of the axes of axles 40 and 25 with respect to the support of arm **35*b* on wedge 38**.

The moments induced in the front and rear portions of the base depend on the intensity of forces F1 and F2 as well as the height of the axes of axles 42 and 20 with respect to the upper surface of the base.

Figure 6:
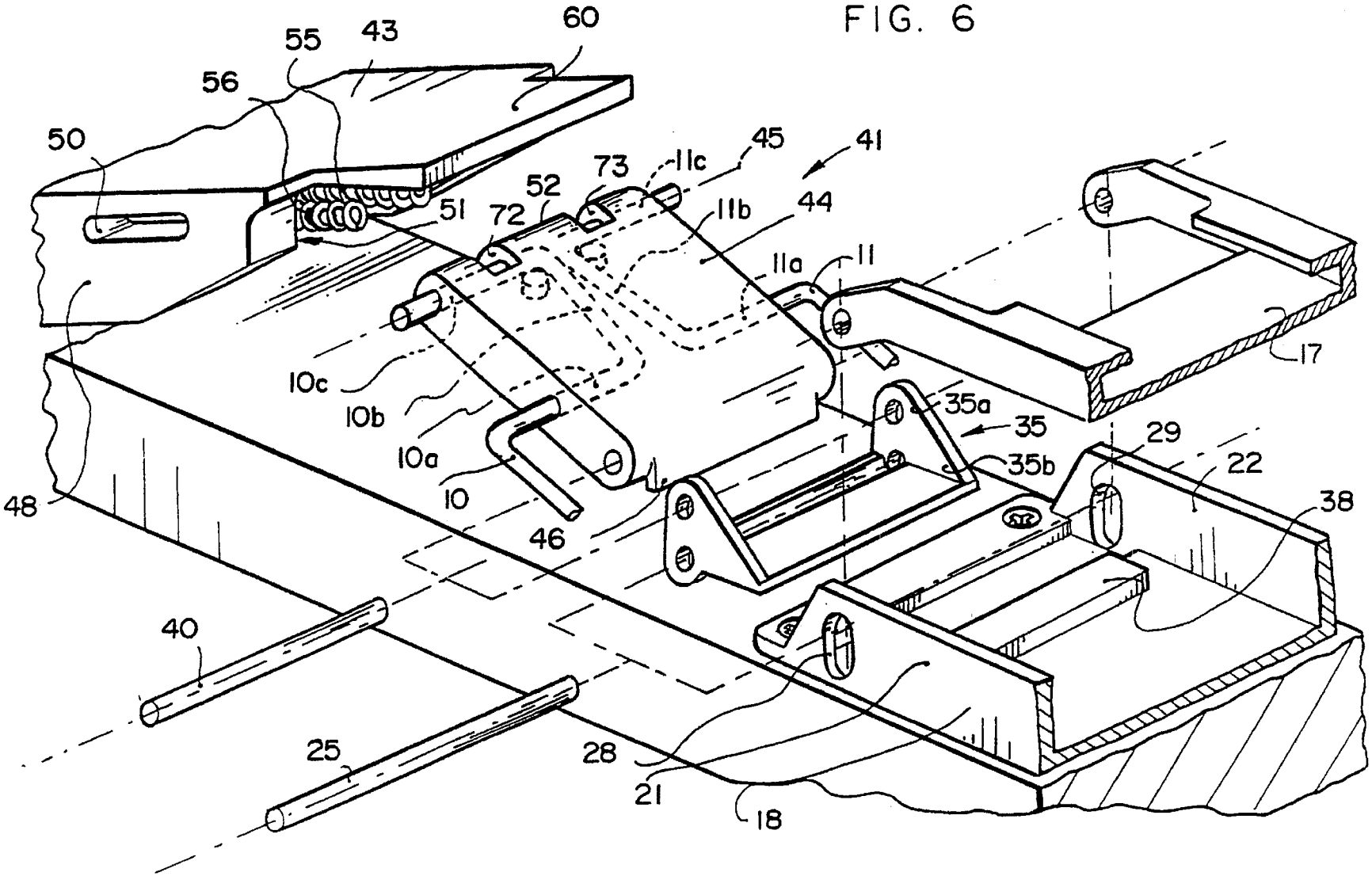
FIG. 6 is a partial exploded perspective view of the linking means which equip the device.

When the additional thrust P stops, the flexional moments induced on the front and rear ends of the ski diminish, the tipping element is returned to its normal resting position, i.e., the position illustrated in FIG. 6, which brings back plate 60 into its upper position, until the ends of axle 25 come into abutment in slots 28 and 29.

The additional thrust P thus engenders flexional moments on the front and rear of the ski. In addition, it brings about a vertical downward movement of plate 60 on which the rear end of the boot rests. This movement is opposed by an elastic energy. There is thus a vertical shock absorption or suspension effect of the rear end of the sole of the boot.

If the boot leaves the binding elements which retain it onto the ski, or if one or the other of the binding elements is released accidentally or voluntarily, springs 55 and 56 elastically bring back the knuckle joint that constitutes the front linking element 41 into its open position. The pre-stress that the device induces on ski 1 disappears.

Thus, this pre-stress that the linking means induce in the base is only present when the boot itself is present in the bindings, and it disappears automatically as soon as the boot leaves the binding elements. The ski is therefore subject to pre-stress only during skiing, and there is no risk of it being irreversibly deformed by a pre-stress that is exerted permanently.

According to another characteristic of the invention, a braking device of the ski is linked to the front linking element 41 described hereinabove. In a known manner, such a braking device comprises at least one braking arm, and preferably two arms 10 and 11 that are movable between a resting position and an active working position. In the resting position, the braking arms 10 and 11 are raised above the upper surface of base 1, and in the working position, they project beneath the upper surface of base 1, so as to get implanted in the snow.

Passage from one position to the other is obtained by activation means that act in accordance with the presence or absence of the boot in the binding elements. According to the invention, the activation means are constituted by one of levers 43 and 44, or by the combined action of these two levers. On the other hand, advantageously, the braking arms 10 and 11 are carried in an affixed manner by one of the levers and, therefore, they are movable with the movement of such lever from the flattened position to the open position of knuckle joint 41. Springs 55 and 56 that elastically return the knuckle joint constituting the front linking element 41 towards its open position also constitute the return springs of the braking device towards its working position.

In the embodiment illustrated in the drawings, braking arms 10 and 11 are connected in an affixed preferably rigidly manner to lever 44 for its rotational movement about axis 40. Lever 44 constitutes a housing for the brake, the upper portion of braking arms 10 and 11 being maintained therein. FIG. 6 represents braking arms 10 and 11 which penetrate inside the housing by a horizontal and transverse segment **10*a*, 11*a*. The two segments are approximately in alignment with one another, and are located between the axes of axles 40 and 45. The braking arms extend thereafter by two segments 10*b*, 11*b*, that are substantially adjacent, and then by two terminal segments 10*c*, 11*c* oriented towards the outside along a horizontal and transverse direction, approximately in alignment with one another. The terminal segments 10*c* and 11*c* are located in the front portion of housing 44, and their ends project outwardly from the housing. Segments 10*c* and 11*c*, in the embodiment illustrated, constitute the journal axis of axle 45 which connects both levers 43 and 44**.

The braking arms 10 and 11 thus pivot with lever 44 between the flattened position of the knuckle joint which corresponds to the resting position of the braking device, and the open position of the knuckle joint which corresponds to the working position of braking arms 10 and 11. Springs 55 and 56 which elastically return the knuckle joint into its open position also constitute the return energy of the braking arms in their working position. It must, however, be noted that springs 55 and 56 are not limiting and that any other elastic return means of lever 44 in the open position of the knuckle joint, that is the position of FIG. 3, could also be used to ensure both the return of the knuckle joint into its open position and of the brake into its working position.

Preferably, an abutment limits the movement of the brake towards its working position, so as to mainly protect the device from shocks that could occur on the rear of the brake spades. Such an abutment is visible in FIGS. 5 and 6, where it is a finger 46 affixed to lever 44 and located in the vicinity of axle 40 at the rear of such axle. This finger takes support from the top on arm **35*b* of tipping element 35 when knuckle joint 41** reaches the extreme open position.

Figure 8:
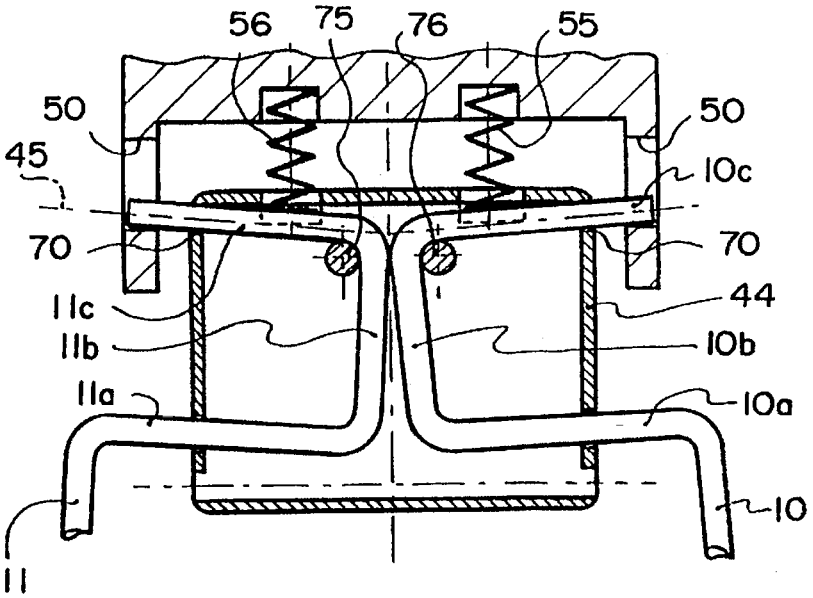
FIGS. 8 and 9 illustrate, in a schematic manner, the functioning mode of the brake according to a preferred embodiment of the invention.
Figure 13:
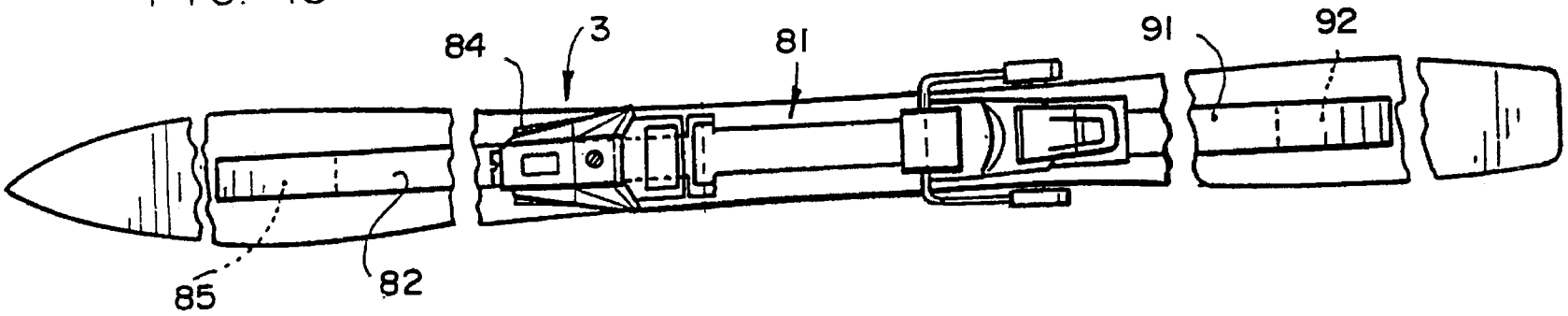
FIG. 13 is a top view of the device represented in FIG. 9.
Figure 14:
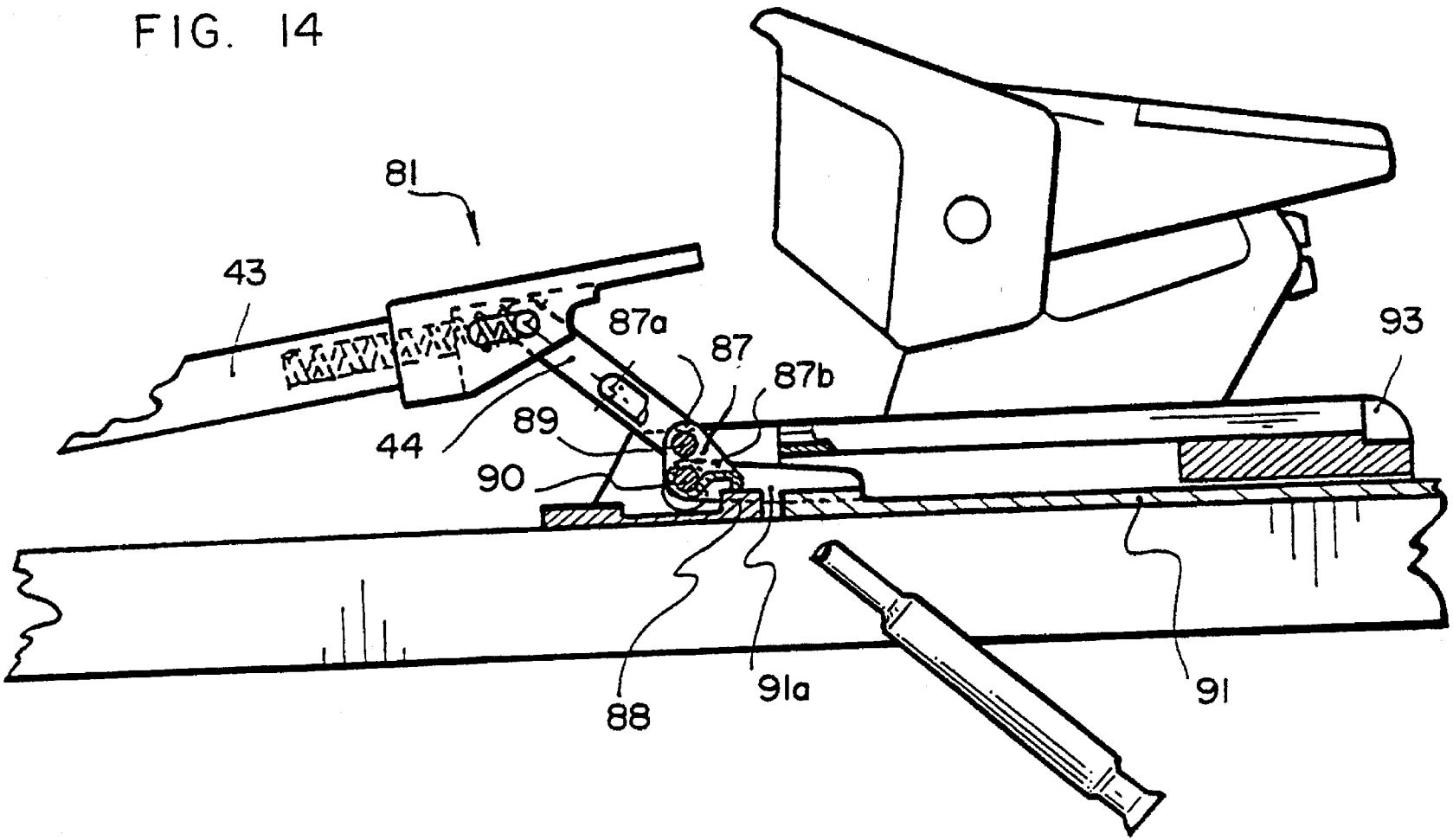
FIG. 14 is a side view, in a partial section, of the device of FIG. 1 at the level of the rear binding element.

According to a preferred embodiment, the braking device also has means to cause the retraction of the braking arms in the resting position, i.e., to bring back the braking arms in this resting position towards the longitudinal axis of the ski. With reference to FIGS. 13 and 14, the braking arms 10 and 11 can oscillate in the plane defined by housing 44 around openings 70 (see FIG. 8) crossed by segments **10*c* and 11*c*. In addition, the front portion of housing 44 has two openings 72 and 73 that springs 55 and 56 cross so as to take support against segments 10*c* and 11*c* inwardly with respect to openings 70. Springs 55 and 56 thus simultaneously have an action on lever 44 and an action on the braking arms that tends to separate braking arms 10 and 11 with respect to the longitudinal axis of the ski, as is diagrammatically represented in FIG. 13. This separated position particularly corresponds to the open position of the knuckle joint. In this position, the ends of segments 10*c* and 11*c* take support against the rear end of slot 50, which also promotes separation of braking arms 10 and 11. The separation is preferably limited by plugs 75 and 76** that are located inside the housing.

In the flattened position of the knuckle joint, the ends of segments **10*c* and 11*c* of the braking arm take support against the front end of slot 50, and this causes pivoting of the braking arms in the plane defined by lever 44 around openings 70**. In this position, the braking arms come closer to the longitudinal axis of the ski.

The support of segments 10*c* and 11*c* against the front end of slot 50 only occurs at the end of the flattening movement of the knuckle joint, i.e., the retraction of the brake takes place after the braking arms have accomplished their rotational movement which brings them above the upper surface of the ski. When knuckle joint 41 is located in an intermediate position between the flattened and the open positions, it is springs 55 and 56 that exert an elastic action on segments 10*c* and 11*c*. This action tends to separate braking arms 10 and 11 from the longitudinal axis of the ski.

Naturally, the retraction means that have been described are not limiting in nature, and other means can be implemented, especially means that would act at the level of segments 10*a* and 11*a* of the brake.

Figures 5, 10:
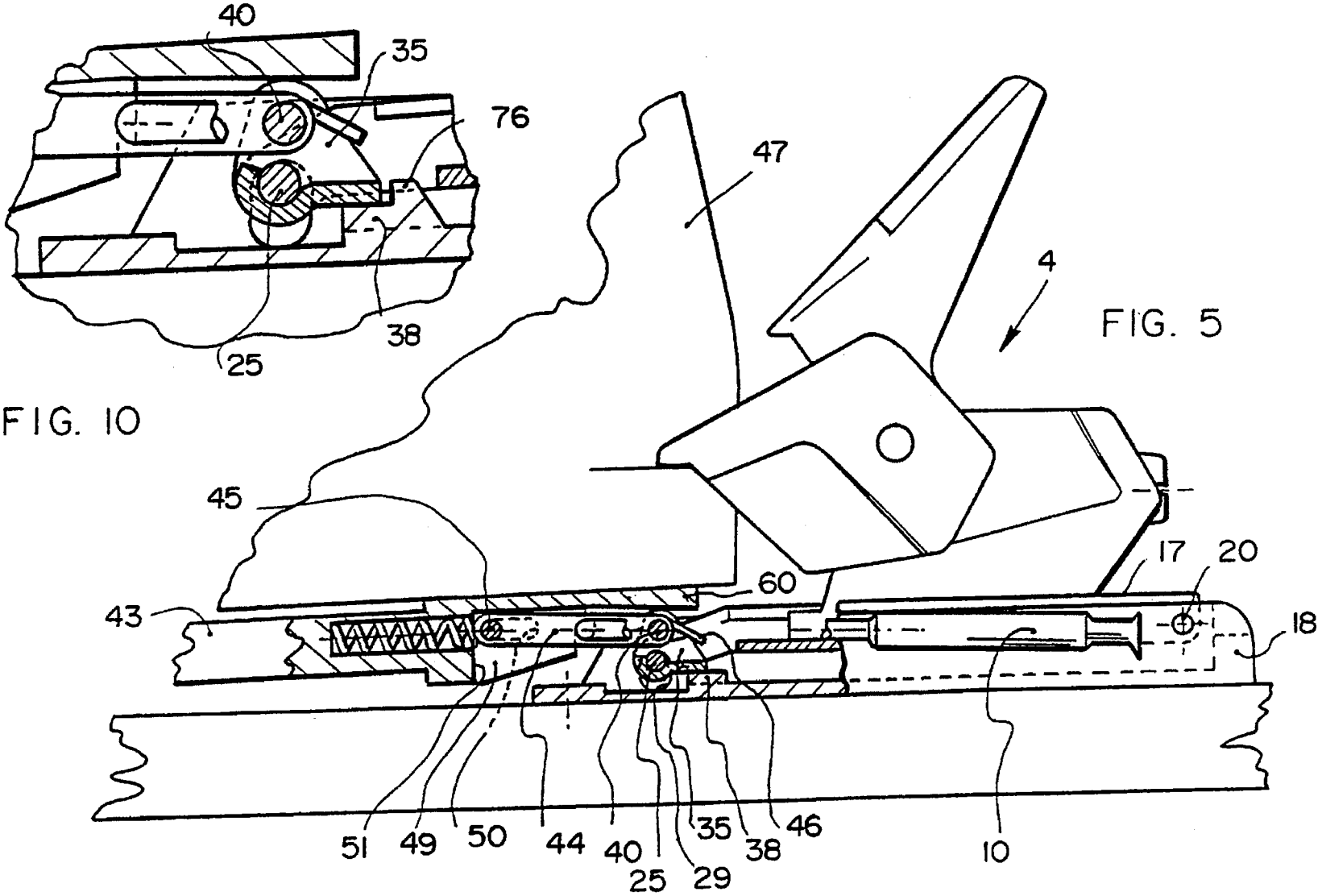
FIG. 5 is a side view, in a partial section, of the device of FIG. 1 in the rear binding element zone.
FIGS. 10 and 11 illustrate variations of the invention.

FIG. 10 illustrates a constructional variation of the device at the level of the linking means. According to this variation, wedge 38 on which tipping element 35 takes support has, towards the rear, a longitudinal abutment 76. When the tipping element 35 is biased rotationally by thrust P exerted by the boot, longitudinal abutment 76 absorbs the rearward longitudinal thrust force which is induced by the rotation of tipping element 35. Contrary to the above-mentioned case, this thrust is transmitted to the ski at the level of wedge 38, instead of rear journal axle 20. The flexional moment at the rear of the ski which is induced by tipping element 35 is therefore transferred to the benefit of an increased flexional moment which the front linking element 41 induces on the front end of the ski.

It is also possible for the longitudinal wedge 76 to occupy a variable longitudinal position with respect to the rear end of tipping element 35, in such a way that the tipping element takes support against wedge 76 only after a predetermined rotation.

FIG. 11 represents another variation of the embodiment according to which the support of tipping element 35 on wedge 38 is longitudinally movable.

This enables the lever arm to be varied, the tipping element taking support therewith to cause the movement of axles 25 and 40.

A rearward displacement of the support increases the thrust action exerted by tipping element 35 on the front and rear linking elements.

On the other hand, if the support of the tipping element on wedge 38 were to be displaced towards the front, the action of the tipping element would decrease.

The adjustment means represented in FIG. 11 comprise a longitudinal groove 77, represented by base plate 18 of the rear binding element. Wedge 38 can be displaced along this groove and immobilized by a screw 78. Naturally, any other means can also be used.

Figure 12:
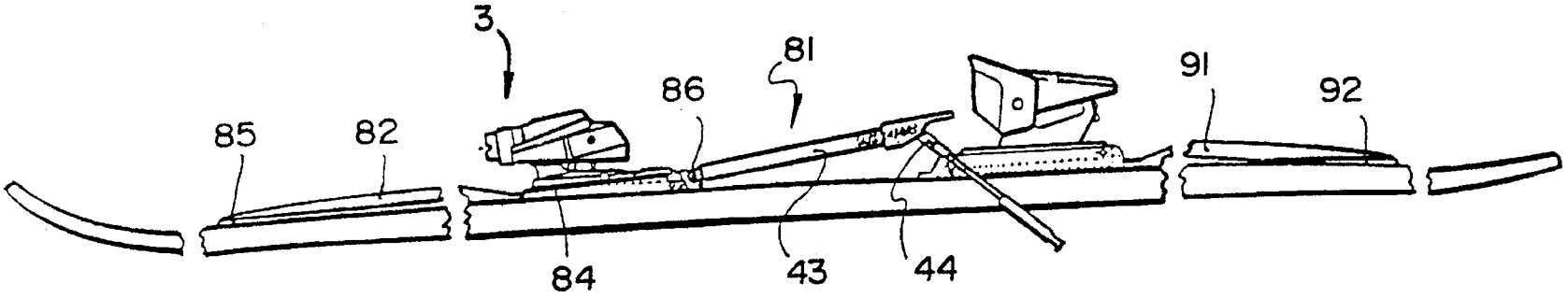
FIG. 12 is a side view of a ski equipped with a device according to another embodiment of the invention.

FIG. 12 illustrates another variation according to which the linking means are directly connected on the base of the ski, without having any effect on the binding elements or their base. This figure represents a linking element 81 similar to the front linking element 41 described hereinabove. Linking element 81 is journalled in its front portion to a stiffening member or stiffener 82 which passes freely beneath base plate 84 of the front binding element 3, and which extends towards the front where its end 85 is affixed to the upper surface of base 1. The journal between linking element 81 and front stiffener 82 is obtained by any appropriate means, for example, by a horizontal and transverse journal axis diagrammatically represented by reference numeral 86.

With reference to FIG. 14, the rear portion of linking element 81 is connected to a tipping element 87 of the same type as tipping element 35 described hereinabove. The horizontal arm 87*b* of the tipping element is in support on a wedge 88 affixed to base 1 of the ski. The linking element 81 is connected to tipping element 87 by a horizontal and transverse axle 89 which is located in the upper portion of the vertical arm 87*a* of the tipping element. Axle 90 which is located substantially beneath axle 89, also connects tipping element 87, not to slide 17, but to a stiffening member 91 that extends towards the rear of the ski, where its end 92 is affixed to base 1. In the example illustrated, the link between the tipping element 87 and rear stiffener 91 is ensured by means of a cap element 91*a* affixed to the front end of stiffener 91. The rear stiffening member 91 freely crosses base plate 93 along a longitudinal direction, the plate bearing rear binding element 4. In the present case, the base plate and the slide of the binding are affixed, i.e., the body of the binding no longer has any oscillatory movement in the median vertical and longitudinal plane of the ski.

The front and rear stiffening members 82 and 91 are obtained from any appropriate material which can resist a compression bias along the longitudinal direction that they define. The front and rear ends 85 and 92 are affixed to the upper surface of base 1 by any appropriate means, and for example, by adhesives, welding or screws or by an attached cap affixed to the base. A layer of shock absorbing material may be positioned between the ends of the stiffeners and the upper surface of the base. Ends 85 and 92 of the front and rear stiffeners are respectively located between the front binding element and the spatula, the rear binding element and the heel. For example, these ends are located in the front quarter and the rear quarter of base 1.

This constructional variation functions in a similar manner to the one described previously, except for the fact that the frontward and rearward longitudinal thrust forces are transmitted to the base, not at the base plates of the binding elements, but to base 1 itself at the level of the front and rear ends 85 and 92. They generate a flexional moment at this level which tends to make the spatula or the heel of the base of the ski bend towards the snow.

The front and rear stiffeners 82 and 91 also play a role in transmitting, from the front to the rear of the ski, or vice versa, the biases to which one end of base 1 is subject.

For example, an upward flexional bias to which the front end of the base is subject generates, in front stiffener 82, a longitudinal thrust force oriented towards the rear, which is transmitted to linking element 81 and to tipping element 87, which, if it does not pivot, transmits the entire bias to rear stiffener 91. At this level, the thrust force generates a flexional moment which bends the rear end of the base towards the snow. Conversely, a flexional bias of the rear end of the base is transmitted towards the front. This construction enables the localized pressure increases of the base on the snow to be balanced.

The front and rear stiffeners 82 and 91 also play a role in the shock absorption of the vertical vibrations to which the front and rear ends of the base are subject. Indeed, these stiffeners preferably have elastic flexional qualities along a vertical direction.

Also, base plates 84 and 93 of the front and rear binding elements straddle stiffening members 82 and 91, having a guiding function for such stiffeners, and they especially stop them from buckling under the effect of a compression bias. Base plates 84 and 93 are, however, affixed to the base, and this results in a good transmission of forces between the boot and the base.

As in the preceding case, in this variation a longitudinal abutment can limit the rearward movement of tipping element 87 and send back the longitudinal rearward thrust forces induced by tipping element 87 to the ski at this level.

Figure 15:
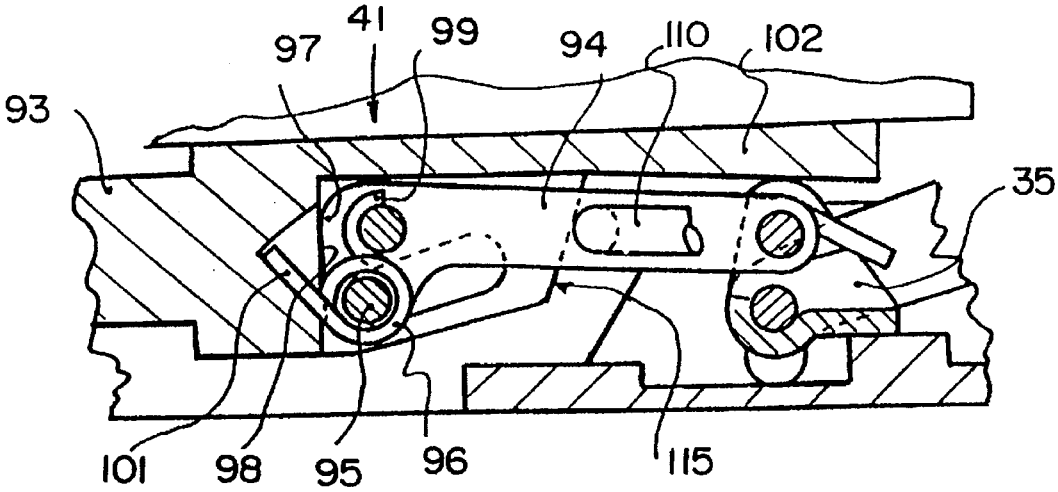
FIGS. 15–17 are related to a variation of the embodiment of the linking means.

FIG. 15 illustrates a variation of the embodiment according to which the elastic return of knuckle joint 41 into an open position is obtained by a torque spring. This spring replaces the thrust springs 55 and 56 described hereinabove.

This figure represents two levers 93 and 94 which constitute knuckle joint 41.

The levers are journalled about an axle 95 which is offset towards the base with respect to the plane defined by the main portion of lever 94.

Axle 95 is borne by lever 94 and its ends rotate in lateral slots in the rear portion of lever 93.

When the knuckle joint is flattened, i.e., in the position represented in FIG. 15, front end 97 of the knuckle joint is in support against a vertical support surface 98 of lever 93 to obtain a coupling of the two levers along a longitudinal direction, i.e., to transmit the thrust forces from one lever to the other along a longitudinal direction.

Figure 16:
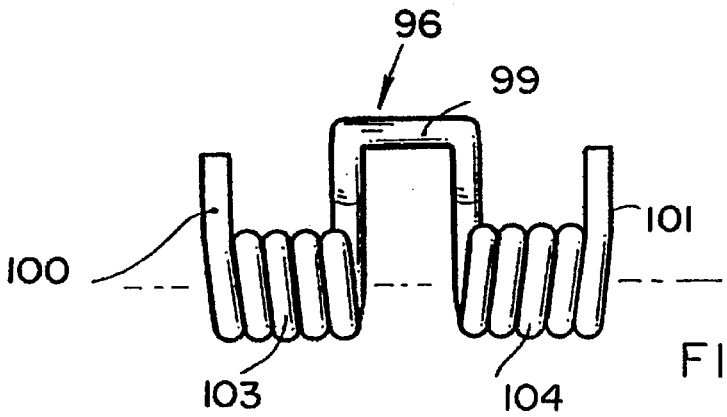

A torque spring 96 visible in FIG. 16 is wound about axle 96. The spring has two symmetrical windings 102 and 103, a central buckle 99 and two free ends 100 and 101.

The free ends 100 and 101 take support on lever 93 in the zone of the vertical support surface 98, whereas the central buckle 99 takes support on the front end 97 of lever 94.

Regardless of the position of the knuckle joint, spring 96 exerts a moment on levers 93 and 94 which elastically returns the knuckle joint towards its open position.

As in the preceding case, a plate 102 extends lever 93 towards the rear and extends above lever 94 in the flattened position of the knuckle joint.

Also, lever 94 bears braking arms 110 and 111, with their segments 110*a, b, c* and 111*a, b, c*, similar to segments 10*a, b, c*, 11*a, b, c*, described previously.

The upper segments 110*c* and 111*c* are shorter than segments 10*c* and 11*c* described previously. Indeed, they no longer have the function of a journal axis between levers 93 and 94.

Figure 17:
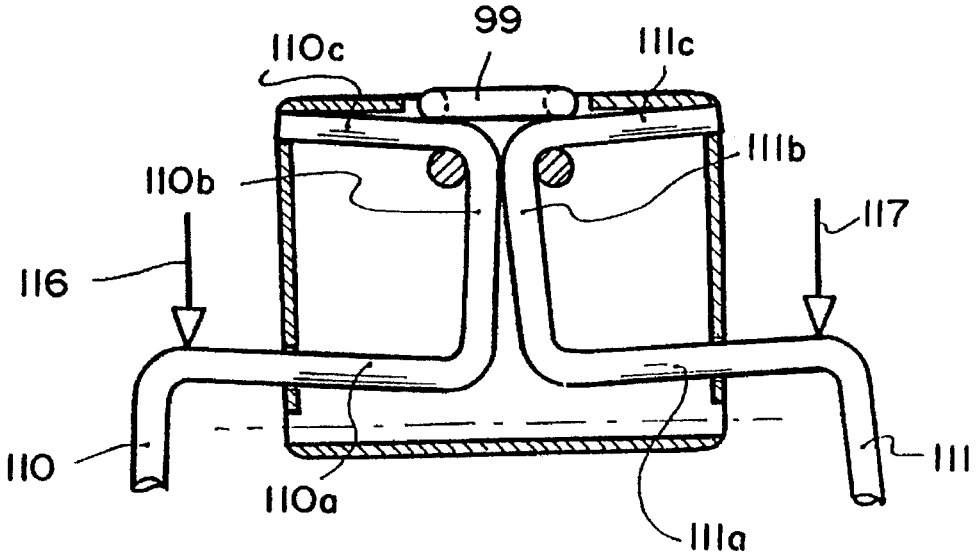

Preferably, as is visible in FIG. 17, lever 94 which constitutes the housing of the brake has, at its end 97, an opening 112 by which buckle 99 of spring 96 takes support against segments 110*c* and 111*c* in the vicinity of the median longitudinal and vertical plane defined by the ski.

The thrust force to which the braking arms are therefore subject tends to elastically keep these braking arms separate.

When the brake is brought to the retracted resting position, lateral ramps 115 borne by the lateral wings of lever 93, beneath pallet 102, take support on segments 110*a* and 110*b* of arms 110 and 111, on the outside of such segments. This action, represented diagrammatically in FIG. 17 by arrows 116 and 117, tends to bring the braking arms closer to the longitudinal axis of the ski, against the elastic return force of spring 96.

Figure 18:
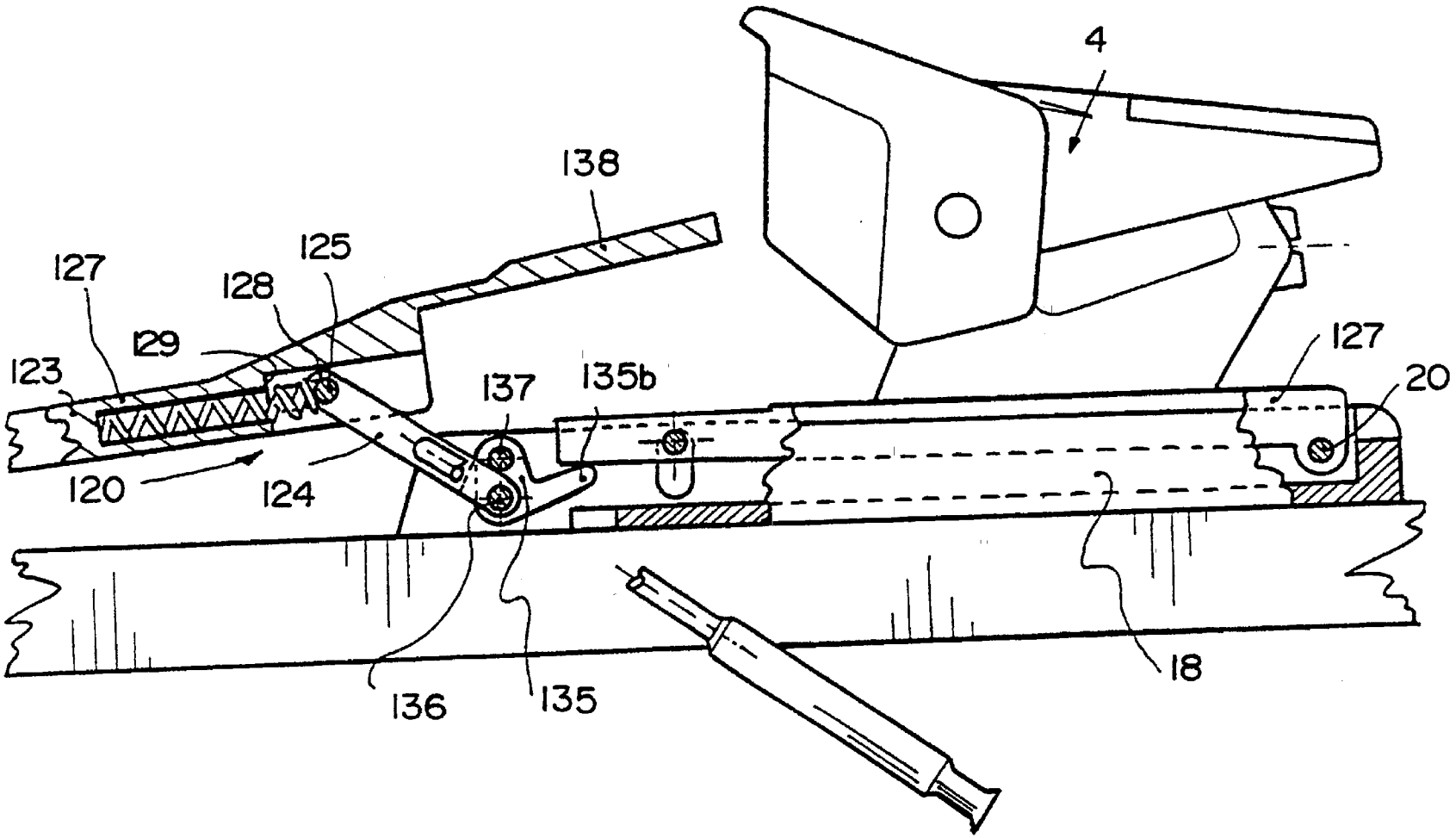
FIGS. 18 and 19 illustrate another variation of the invention.
Figure 19:
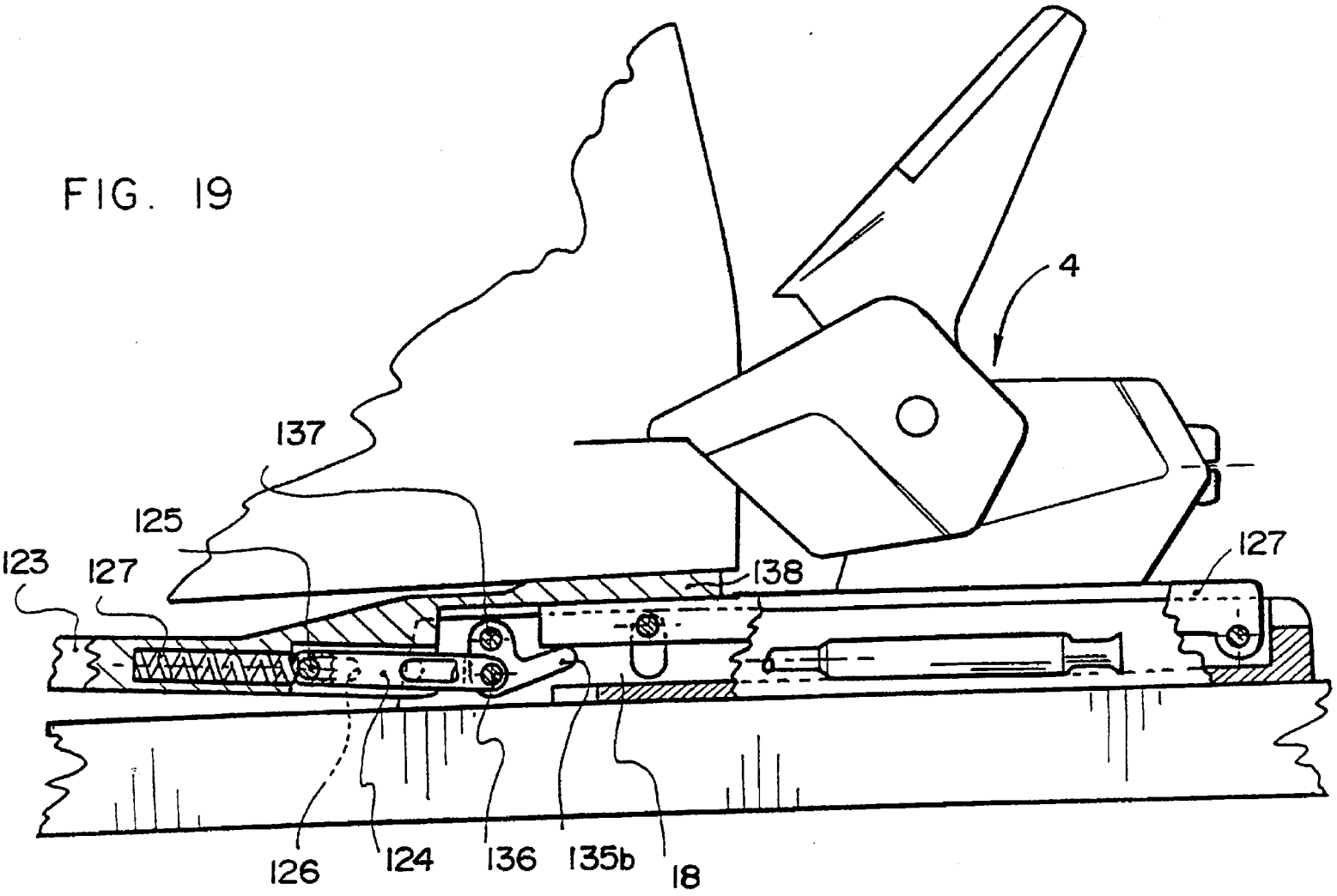

FIGS. 18 and 19 are related to another variation of the invention. According to this variation, the linking means only comprise a front linking element 120.

The linking element 120 comprises two levers 123 and 124 which are of the same type as levers 43 and 44 described previously. The two levers are journalled with respect to each other about an axis 125. The front end is connected to the front binding element in the same way as described with reference to FIGS. 3 and 4, i.e., to base plate 14 by a transverse axis 42.

As in the preceding case, axis 125 is borne by lever 124, and it rotates in a slot 126 of lever 123. Springs 127 elastically push back axle 125 towards the rear end of slot 126.

However, these springs can be replaced by a spring such as spring 96, or by any other elastic return device of the knuckle joint into an open position.

In the flattened position of the knuckle joint, front end 128 of lever 124 comes into contact against a vertical support surface 129 of lever 123.

The free rear end of lever 124 is connected to a tipping element 135 having two arms, about an axis 136 which is located in the central portion of the tipping element.

The tipping element 135 is itself journalled about an axis 137 located in its upper portion, and which is carried by the lateral wings of rear base plate 14.

The tipping element 135 has, towards the rear, an arm 135*b* on which the front portion of rear slide 127 comes to rest, along a vertical direction. This slide, along which the body of rear binding element 4 slides, is journalled with respect to base plate 18 about axis 20 located in its rear portion.

Lever 123 extends towards the rear above lever 124, by a plate 138.

In the flattened position of the knuckle joint, the boot is in support on plate 138 which is itself in support on the front portion of slide 127.

The vertical downward biases of the boot are sensed by sensor 138 and transmitted to tipping element 35 by means of slide 127.

They tend to make tipping element 135 pivot about axis 137, and this drives the journal axis 136 of front lever 123 towards the front.

The biases induce, at the level of the front base plate, a flexional moment which is transmitted to the ski. The reaction is transmitted to the ski in the vicinity of axis 137.

The pre-stress induced in the front linking element is created by the contact of lever 124 against support surface 129, and by the return force of springs 127.

Figure 20:
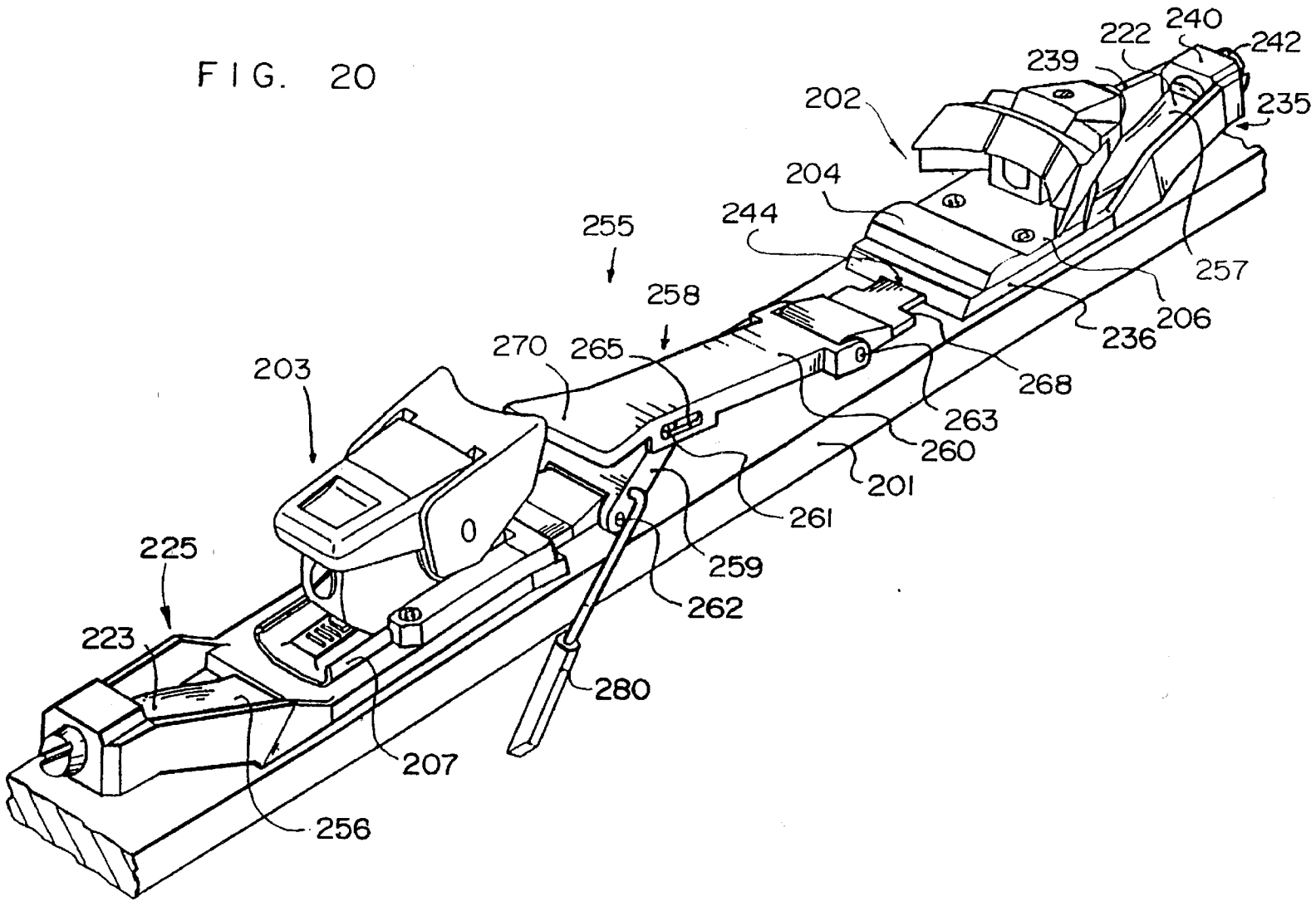
FIG. 20 is a perspective view in the middle sole zone, of a ski equipped with a device according to another embodiment of the invention.

FIG. 20 represents another embodiment of the invention positioned at the middle sole zone of a ski, where front and rear binding elements 202 and 203 are mounted. These binding elements can be of any appropriate type, typically including a jaw which retains the front or rear end of the boot, and which is movable against the return force of an elastic return mechanism.

In addition, front binding element 202 has a base 206 by means of which it is affixed to the ski by any appropriate means, such as, for example, by screws. A support element 204 is further located in the rear portion of base 206, and this support element is intended to receive the front end of the sole of the boot.

In a known manner, rear binding element 203 has a body that is movable along a slide 207, the slide itself being affixed to base 1 by any appropriate means, for example, by screws.

In addition, the device represented in the figures has a stiffening member constituted by a blade 255 which extends above the upper surface of ski 1 along a longitudinal direction. The stiffening member 255 has a central portion 258, which extends approximately between the front and rear binding elements, and two end portions 256 and 257. Central portion 258 will be described later. The ends of the blade are raised with respect to the upper surface of ski 1, and are in support along an approximately longitudinal direction against abutments affixed to the base 201 of the ski. In the presence of the boot, the stiffening member exerts on these abutments a force directed towards the ends of the base.

End portions 256 and 257 of the stiffening member are non-compressible along a longitudinal direction, and further exhibit elastic flexion qualities in the median vertical and longitudinal plane. These portions are made of any appropriate material such as, for example, a fiber-reinforced composite material.

The front and rear ends 222 and 223 of stiffening member 255 are in support along an approximately longitudinal direction against an abutment affixed to the ski.

Figure 21:
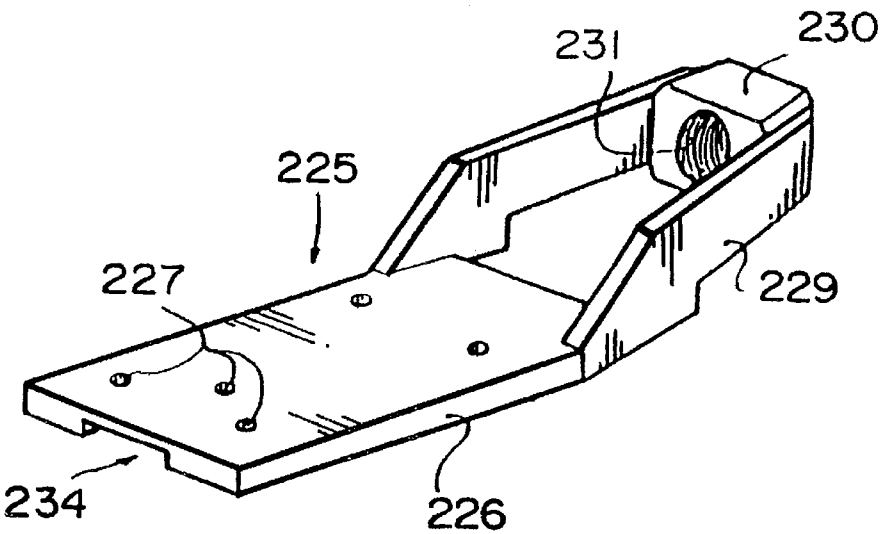
FIG. 21 is a perspective view of a base plate associated with one of the binding elements.
Figure 22:
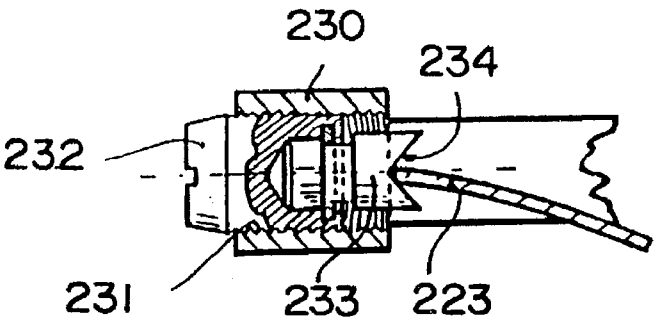
FIG. 22 is a partial sectional side view of the base plate of FIG. 21, which illustrates the connection between the end of the stiffening member and the base plate.

FIGS. 21 and 22 represent such an abutment 225 for rear binding element 203 in the form of base plate 226 adapted to be inserted between slide 207 and the upper surface of base 201. Behind the plate, a stirrup 229 extends along a generally inclined direction such that central portion 230 of the stirrup is raised with respect to the upper surface of base 201. A threaded opening 231 extends in a longitudinal direction through this central portion 230 and a threaded plug 232 is screwed therein to a variable depth. Plug 232 has associated therewith a connecting piece 233, the connecting piece having a notch 234 in which a raised end 223 of the stiffening member takes support along a generally longitudinal direction.

Furthermore, plate 226 has, in its lower portion, a longitudinal groove 234 whose dimensions correspond to those of a transverse section of rear portion 256 of the stiffening member.

According to a variation of the invention, not illustrated, plate 226 is comprised of two portions, one rear portion which bears stirrup 229 and one front portion, independent of the rear portion, which in fact plays the role of a thickened wedge or spacer.

In the vicinity of front binding element 202 is located a base plate 235 of the same type, with a plate 236 inserted between base 206 of binding element 202 and the ski. A stirrup 239, having a central portion 240 equipped with a plug, extends forwardly from plate 236. The front end 222 of the blade is in support against a connecting piece 243, movable along a longitudinal direction with the rotation of plug 242.

In addition, plate 236 has a longitudinal groove 244 whose dimensions are substantially the same as those of a transverse section of front portion 257 of the stiffening member. In its central portion, stiffening member 255 has a toggle joint device 258 which further connects the front end of rear portion 256 to the rear end of front portion 257. In the embodiment represented in the figure, device 258 comprises two levers 259 and 260 which extend along a longitudinal direction, and are mutually journalled about a horizontal and transverse axis 261. Rear lever 259 is journalled at the front end of portion 256, about a horizontal and transverse axis 262. Similarly, front lever 260 is journalled at the rear end of blade portion 257, about a horizontal and transverse axis 263. In the example illustrated, the ends of stiffener portions 256 and 257, to which are connected levers 259 and 260, are equipped with a connecting piece 266 and 267, respectively, traversed by axes 262 and 263. Axle 261, which connects the two levers 259 and 260, is borne by lever 259, and is movable along the longitudinal direction of lever 260 along a slot 265, located in the rear portion thereof. In its rear portion, lever 260 further has at least one spring that elastically pushes axis 261 towards the rear end of slot 265.

Preferably, lever 260 extends beyond axis 261 through a plate or extension 270 which covers lever 259 when toggle joint 258 is in its closed or flattened position. In this flattened position, a lower abutment 271 of lever 260 prevents journal axle 261 from passing beneath the alignment of the other two axes 262 and 263, such that the toggle joint is never completely latched in a stable closed position and tends to open permanently under the thrust force of spring 269. Preferably also, in the flattened position of the toggle joint, front end 274 of lever 259 comes in support against an abutment surface 275, displayed by lever 260 directly behind slot 265. In this manner, in the flattened position of toggle joint 258, it is possible to put both levers 259 and 260 in abutment against on another, along a longitudinal direction.

However, one can leave a slight clearance in this area. The stiffening member then exerts an elastic stress on base plates 225 and 235 as long as there is a clearance, followed by a non-elastic stress when front end 274 of lever 259 comes in abutment against abutment surface 275. The stiffening member then stresses the base elastically in a first phase of its flexion, and non-elastically thereafter.

The assembly described hereinabove operates in the following manner.

Figure 23:
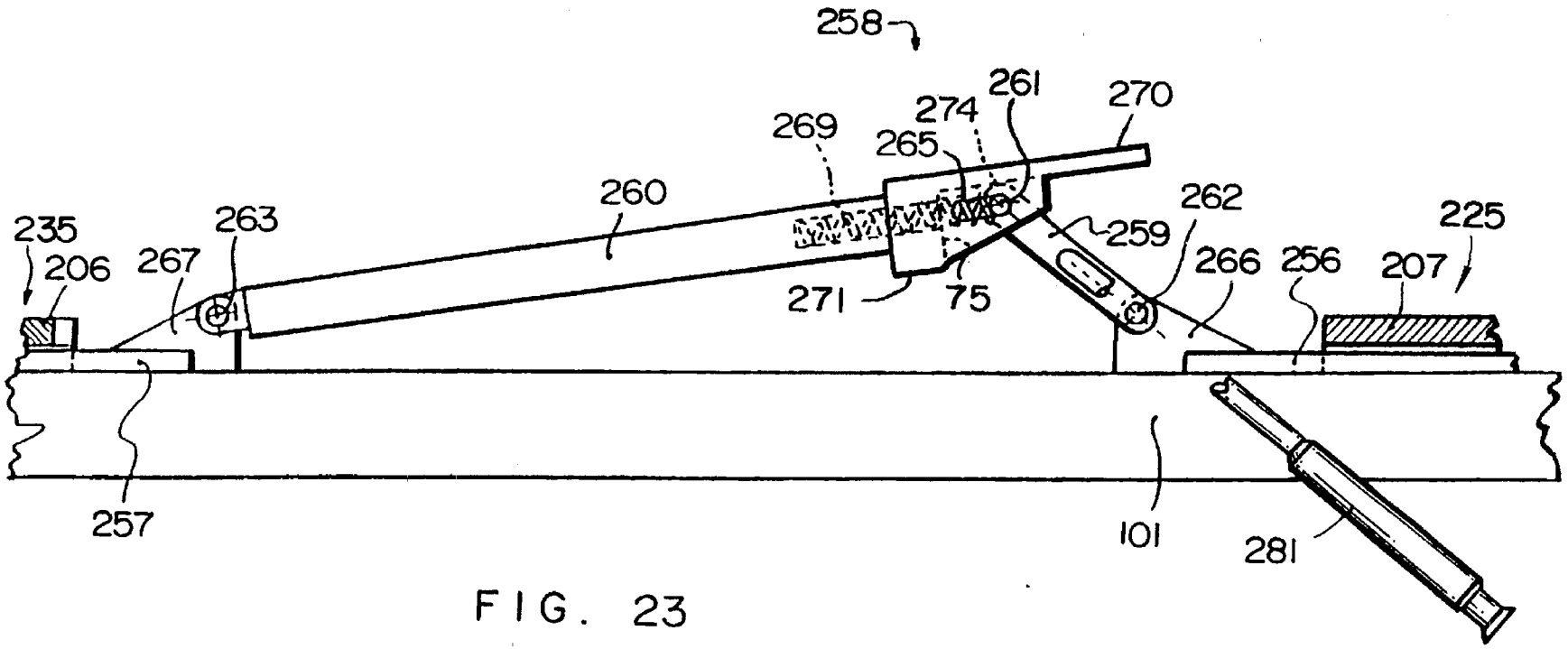
FIG. 23 is a partial side view which illustrates the operation of the device present in FIG. 8, the binding elements are not shown in this figure.
Figure 24:
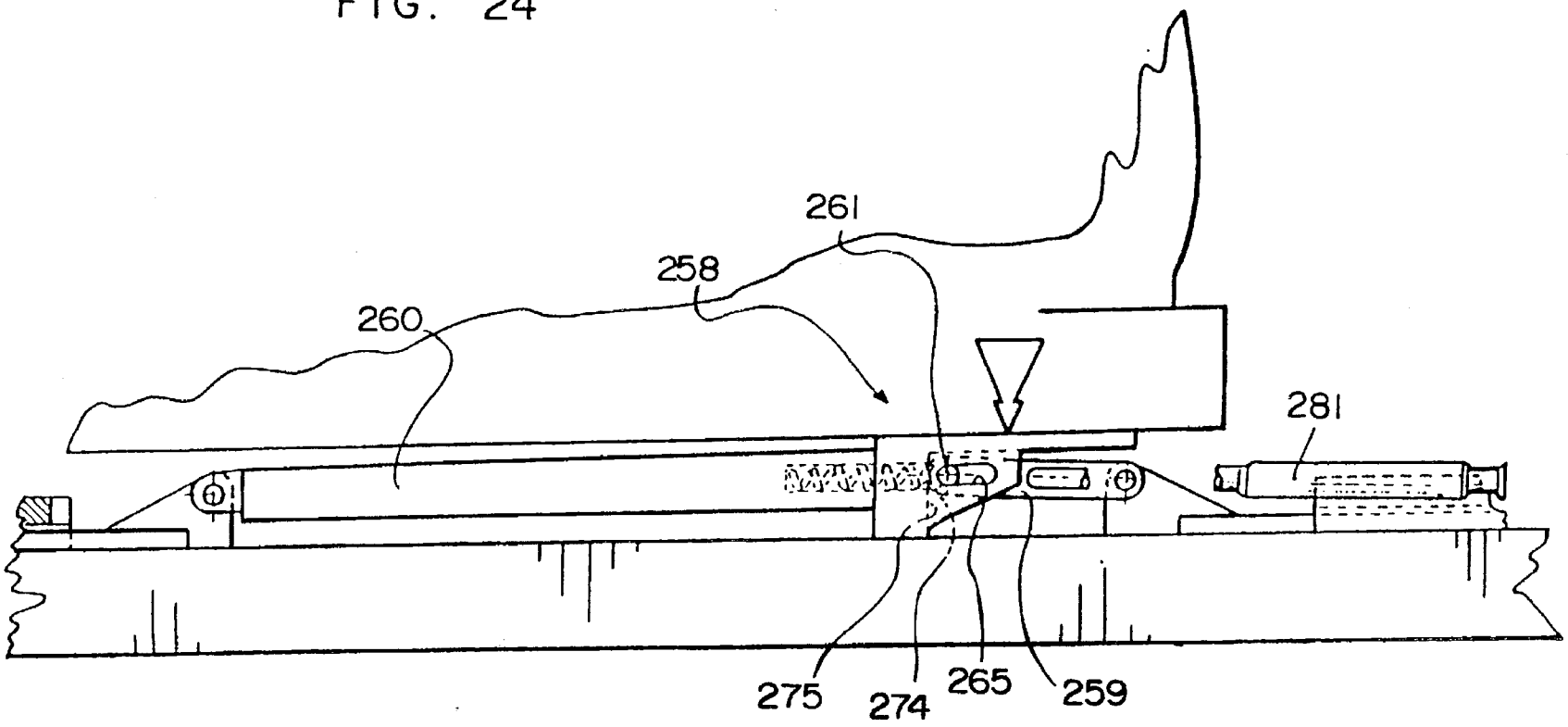
FIG. 24 is a view similar to FIG. 9 in another operative position.

In the absence of the boot, i.e., in the position represented in FIG. 23, toggle joint 258 is elastically returned into the open position by spring 269. When the boot is engaged in the binding, toggle joint 258 is brought into its flattened position schematized in FIG. 24.

In this position, the length of the stiffening member 255 is approximately equal to the distance between the two connecting pieces of base plates 225 and 235.

Thus, if plugs 232 and 242 are screwed against the ends of member 255 beforehand, a compression stress, opposed by the blade, is generated in member 255. This stress is transmitted by reaction to each of base plates 225, 235 which, in turn, transmit to the base of the ski a flexional moment that would tend to make the front and rear ends of the base move in the direction of the snow. The compression stress to which the stiffening member would be subjected, and thus the intensity of the flexional moments induced, can be adjusted by means of threaded plugs 232 and 242. The intensity of the flexional moments also depends upon the height of ends 222 and 223 of the stiffener, with respect to the upper surface of the base of the ski.

In this position of the stiffener, spring 269 generates an elastic compression stress between the levers of toggle joint 258 and, therefore, in the entire stiffening member, which is transmitted to base plates 225 and 235. When the boot is disengaged from the binding, either accidentally or voluntarily, spring 269 returns toggle joint 258 into the open position of FIG. 23, which cancels the prior compression stress.

Depending upon the adjustment of the plugs 232 and 242, front end 274 of lever 259 will or will not be in contact with abutment surface 275 of lever 260 in the flattened position of the toggle joint. If there is no contact, the stiffening member will generate, on the front and rear base plates, a thrust force which tends to increase with the flexions of the ski. Indeed, these flexions of the ski tend to bring the two portions 256 and 257 closer together, resulting in an additional compression of spring 269.

If there is contact, the stiffening member behaves like a non-compressible stiffening blade.

Also, it would be possible in this case to make a shoulder in either portion 256 or 257 cooperate with the plate of either binding element. FIG. 20 illustrates a shoulder 268 which is adapted to cooperate with the frontal surface of plate 236, depending upon the adjustment of plugs 232 and 242.

Lever 259 bears braking arms 280 and 281. These braking arms follow the rotational movements of lever 259 about axis 262. FIG. 23 represents lever 259 in the inclined position, which causes braking arms 280 and 281 to project beneath the lower surface of ski 1. Conversely, in FIG. 24, lever 259 extends substantially along a horizontal direction, and braking arms 280 and 281 are brought back above the upper surface of the ski.

Thus, toggle joint 258, when it is brought into the flattened position, exerts two different actions. On the one hand, it generates a compression stress in stiffening member 255, and on the other hand, it brings back the braking arms from their working position to their resting position.

Figure 9:
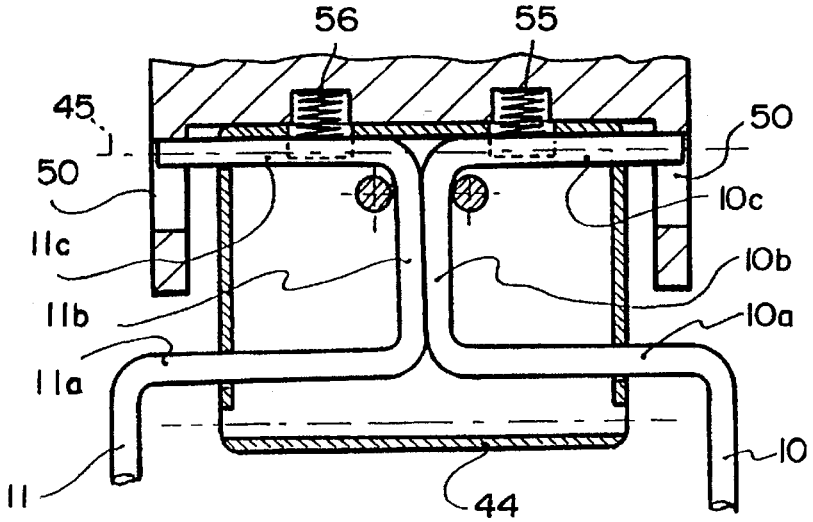

Preferably, in the resting position, means further cause the retraction of the brake, i.e., the coming together of arms 280 and 281 towards the longitudinal axis of the ski. These means are, for example, of the same type as those described hereinabove relative to FIGS. 8 and 9.

Similarly, according to a variation of the invention, spring 269 could be replaced by a spring of the same type as spring 96 of FIG. 16. It is understood that other springs are also suitable, especially springs acting between either of the two levers and the ski.

Naturally, the present description is only provided as a non-limiting example, and other variations of the invention can be adopted without leaving the scope of such invention.

In particular, the various embodiments which have been described could be equipped with a length adjustment device, so as to adapt the linking means to various boot lengths.

Finally, although the invention has been described with reference of particular means, materials and embodiments, it is to be understood that the invention is not limited to the particulars disclosed and extends to all equivalents within the scope of the claims.

What is claimed is:

1. A ski brake adapted to brake the movement of a ski upon release of a boot that is held on the ski by at least one binding element of a front binding element and a rear binding element, the front binding element and the rear binding element each having a base to be affixed to the ski, the ski having a base with a lower surface and an upper surface, said ski brake comprising:

two braking arms mounted for movement in the vicinity of the rear binding element between a lowered working position in which said braking arms project beneath the lower surface of the base of the ski and a raised resting position in which said braking arms are positioned along lateral edges of the base of the ski;

an activation mechanism for returning said braking arms from said working position to said resting position during engagement of the boot in the at least one binding element;

an elastic return mechanism for elastically returning said braking arms into said working position during release of the boot;

said activation mechanism including:

a rear lever rigidly connected to said braking arms, said rear lever forming an extension of the braking arms beyond the upper surface of the base of the ski, said rear lever being mounted for movement about a transverse axis in the vicinity of the rear binding element; and a front lever having a rear end portion, said rear lever and a predeterminate area of said rear end portion of said front lever forming a pivotal and slidable connection, said front lever being pivotally connected to an element associated with a front binding and adapted to be affixed with respect to the ski in the vicinity of the front binding element, said front and rear levers assuming a lowered substantially coplanar position when the braking arms are in their resting position, and said elastic return mechanism functioning to bias the connection between said front and rear levers upwardly away from the upper surface of the ski to a raised non-coplanar position and to move said braking arms into said lowered working position.

2. A ski brake according to claim 1, wherein:

said front lever has a plate with an upper surface, said upper surface being positioned in an area for supporting a sole of the boot.

3. A ski brake according to claim 2, further comprising:

a tipping element mounted for rotation in response to and controlled by a support force exerted on said upper surface of said plate of said front lever; and a journal connection between said rear end of said rear lever and said tipping element.

4. A ski brake according to claim 3, further comprising:

a base plate positioned beneath the rear binding element, said tipping element being journalled about an axis supported by said base plate, said base plate to be affixed to the base of the ski.

5. A ski brake according to claim 1, wherein:

said rear lever has a freely projecting front end which extends beyond said predeterminate area of said rear lever; and said ski brake further comprising means for guiding said freely projecting front end of said rear lever for sliding movement with respect to said front lever beneath said rear end of said front lever.

6. A ski brake according to claim 5, wherein:

said energy mechanism comprises a compression spring for elastically biasing said front end of said rear lever toward said rear end of said front lever.

7. A ski brake according to claim 1, wherein:

said rear end of said front lever comprises a slot; and said rear lever comprising a front end, said front end of said rear lever being guided along said slot of said front lever.

8. A ski brake according to claim 1, wherein:

said energy mechanism comprises a torque spring, said torque spring having a pair of opposite ends, each of said pair of opposite ends of said torque spring being positioned for biasing one of said levers in an angular manner.

9. A ski brake according to claim 1, wherein:

both of said levers are arranged in a manner whereby in the presence of the boot, both of said levers assume a co-extensive position and extend substantially between said front binding element and said rear binding element.

10. A ski brake according to claim 7, wherein:

in said co-extensive position, said front end of said rear lever is in abutment against a support surface of said front lever.

11. A ski brake according to claim 9, wherein:

in said co-extensive position, both of said levers exert pre-stress force between said front and rear binding elements.

12. A ski brake according to claim 1, further comprising:

a first blade portion having one end in abutment against the base of the rear binding element and a second blade portion having one end in abutment against the base of the front binding element, wherein the rear lever is connected to said first blade portion and said front lever is connected to said second blade portion.

13. A ski brake according to claim 12, wherein:

said first blade portion and said second blade portion are non-compressible in a longitudinal direction for exerting a longitudinal force against the base of the front binding element and the base of the rear binding element in resting position of said braking arms.

14. A ski brake according to claim 1, further comprising:

a stiffening apparatus for exerting a flexional moment in a direction tending to cause opposite ends of the ski to bend downwardly, said stiffening apparatus comprising:

a first base plate adapted to be affixed with respect to the ski in the vicinity of the rear binding element;

a second base plate adapted to be affixed with respect to the ski in the vicinity of the front binding element;

a first stiffener portion having one end connected to said rear lever of said activation mechanism and another end extending longitudinally from said rear lever to a connection with said first base plate;

a second stiffener portion having one end connected to said front lever of said activation mechanism and another end extending longitudinally from said front lever to a connection with said second base plate;

wherein said activation mechanism for returning said braking arms from said working position to said resting position furthermore comprises an activation mechanism for exerting a longitudinal force against said first base plate and against said second base plate in said resting position of said braking arms.

15. A ski binding assembly for retaining a boot in support upon a ski in combination with a brake according to claim 1, wherein said ski binding assembly comprises said front binding element and said rear binding element.

16. A ski in combination with said ski binding assembly according to claim 15.

17. A ski brake according to claim 1, wherein:

said element adapted to be affixed with respect to the ski in the vicinity of the front binding element comprises the base of the front binding element.

18. A ski brake according to claim 1, wherein:

said energy mechanism comprises means for moving said rear end portion of said front lever upwardly when said braking arms are returned to said working position during release of the boot.

19. A ski brake according to claim 1, wherein:

said braking arms extend downwardly and rearwardly in said lowered working position.

20. A ski brake according to claim 1 in combination with said front binding element, said front binding element including a support for supportingly engaging, independent of said front lever, a front portion of the boot.

21. A ski brake according to claim 1 in combination with said front binding element and said rear binding element, each of said front binding element and said rear binding element including a respective support for supportingly engaging, independent of said front lever and said rear lever, a front portion of the boot and a rear portion of the boot, respectively.

22. A ski brake adapted to brake the movement of a ski upon release of a boot that is held on the ski by at least one binding element of a front binding element and a rear binding element, the front binding element and the rear binding element each having a base to be affixed to the ski, the ski having a base with a lower surface and an upper surface, said ski brake comprising:

two braking arms mounted for movement in the vicinity of the rear binding element between a lowered working position in which said braking arms project beneath the lower surface of the base of the ski and a raised resting position in which said braking arms are positioned along lateral edges of the base of the ski;

an activation mechanism for returning said braking arms from said working position to said resting position during engagement of the boot in the at least one binding element;

an elastic return mechanism for elastically returning said braking arms into said working position during release of the boot;

a retraction mechanism for moving said brake arms in a direction having at least a component of motion toward a longitudinal axis of the base of the ski as the braking arms are moved from said lowered working position to said raised resting position;

said activation mechanism including:

a rear lever operatively connected to said braking arms, said rear lever forming an extension of the braking arms beyond the upper surface of the base of the ski, said rear lever being mounted for movement about a transverse axis in the vicinity of the rear binding element; and a front lever having a rear end portion, a predeterminate area of said rear end portion of said front lever being connected to said rear lever, said front lever being operatively connected to an element adapted to be affixed with respect to the ski in the vicinity of the front binding element.

23. A ski brake adapted to brake the movement of a ski upon release of a boot that is held on the ski by at least one binding element of a front binding element and a rear binding element, the front binding element and the rear binding element each having a base to be affixed to the ski, the ski having a base with a lower surface and an udder surface, said ski brake comprising:

two braking arms mounted for movement in the vicinity of the rear binding element between a lowered working position in which said braking arms project beneath the lower surface of the base of the ski and a raised resting position in which said braking arms are positioned along lateral edges of the base of the ski;

an activation mechanism for returning said braking arms from said working position to said resting position during engagement of the boot in the at least one binding element;

an elastic return mechanism for elastically returning said braking arms into said working position during release of the boot;

a vertically movable sensor for supporting a force applied by a rear end of the boot; and a tipping element and means for journalling said tipping element for rotation about a transverse axis, said rear lever being journalled to said tipping element, said vertically movable sensor being operatively connected to said tipping element for controlling said rotation of said tipping element;

said activation mechanism including:

a rear lever operatively connected to said breaking arms, said rear lever forming an extension of the braking arms beyond the upper surface of the base of the ski, said rear lever being mounted for movement about a transverse axis in the vicinity of the rear binding element; and a front lever having a rear end portion, a predeterminate area of said rear end portion of said front lever being connected to said rear lever, said front lever being operatively connected to an element adapted to be affixed with respect to the ski in the vicinity of the front binding element.

24. A ski brake according to claim 23, wherein:

said means for journalling said tipping element for rotation about a transverse axis is borne by the base of the ski;

said tipping element has a free arm; and said vertically movable sensor bears against said free arm of said tipping element for rotation of said tipping element.

25. A ski brake according to claim 23, wherein:

said means for journalling said tipping element for rotation about a transverse axis is borne by the rear binding element;

said tipping element has a free arm; and said free arm is supported against an abutment to be affixed with respect to the ski.

26. A ski brake adapted to brake the movement of a ski upon release of a boot that is held on the ski by at least one binding element of a front binding element and a rear binding element, the front binding element and the rear binding element each having a base to be affixed to the ski, the ski having a base with a lower surface and an upper surface, said ski brake comprising:

two braking arms mounted for movement in the vicinity of the rear binding element between a lowered working position in which said braking arms project beneath the lower surface of the base of the ski and a raised resting position in which said braking arms are positioned along lateral edges of the base of the ski;

an activation mechanism for returning said braking arms from said working position to said resting position during engagement of the boot in the at least one binding element;

an elastic return mechanism for elastically returning said braking arms into said working position during release of the boot;

said activation mechanism including:

a rear lever connected to said braking arms to secure said rear lever against separation from said braking arms in said working position of said braking arms, said rear lever forming an extension of the braking arms beyond the upper surface of the base of the ski, said rear lever being mounted for movement about a transverse axis in the vicinity of the rear binding element; and a front lever having a rear end portion, said rear lever and a predeterminate area of said rear end portion of said front lever forming a pivotal and slidable connection, said front lever being pivotally connected to an element adapted to be affixed with respect to the ski in the vicinity of the front binding element;

said front and rear levers assuming a lowered substantially coplanar position when the braking arms are in their resting position, and said elastic return mechanism functioning to bias the connection between said front and rear levers upwardly away from the upper surface of the ski to a raised non-coplanar position and to move said braking arms into said lowered working position.

27. A ski brake adapted to brake the movement of a ski upon release of a boot that is held on the ski by at least one binding element of a front binding element and a rear binding element, the front binding element and the rear binding element each having a base to be affixed to the ski, the ski having a base with a lower surface and an upper surface, said ski brake comprising:

at least one braking arm mounted for movement in the vicinity of the rear binding element between a lowered working position in which said braking arm projects beneath the lower surface of the base of the ski and a raised resting position in which said braking arm is positioned along lateral edges of the base of the ski;

an activation mechanism for returning said braking arm from said working position to said resting position during engagement of the boot in the at least one binding element;

an elastic return mechanism for elastically returning said braking arm into said working position upon the release of the boot from engagement with the rear binding element;

said activation mechanism including:

a rear lever rigidly connected to said braking arm and extending from said braking arm in a direction beyond the upper surface of the base of the ski, said rear lever being mounted for movement about a transverse axis in the vicinity of the rear binding element; and a front lever having a rear end portion, said rear lever and a predeterminate area of said rear end portion of said front lever forming a connection, said front lever extending from an element adapted to be affixed with respect to the ski in the vicinity of the front binding element to the vicinity of a rear portion of the sole of the boot when the boot is secured in the bindings;

said front and rear levers assuming a lowered substantially coplanar position when said braking arm is in said resting position, and said elastic return mechanism functioning to bias the connection between said front and rear lever upwardly away from the upper surface of the ski to a raised non-coplanar position and to move said braking arm into said lowered working position.

28. A ski brake according to claim 27, wherein:

said front lever comprises a plate for engagement with the rear portion of the sole of the boot, said front lever constituting a long activation pedal for said brake arm, said front lever extending beneath substantially the entire length of the sole of the boot.

29. A ski brake according to claim 27, wherein:

said elastic return mechanism comprises means for moving said rear end portion of said front lever upwardly when said braking arm is returned to said working position during release of the boot.

30. A ski brake according to claim 27 in combination with said front binding element, said front binding element including a support for supportingly engaging, independent of said front lever, a front portion of the boot.

31. A ski brake according to claim 27, wherein:

said rear lever is connected to said braking arm to secure said rear lever against separation from said braking arm in said working position of said braking arm.

32. A ski brake according to claim 27, wherein:

said activation mechanism comprises at least a part of a means for applying a force for stiffening flexion of the ski.

* * * * *